US005741381A

United States Patent [19]

Dolence et al.

[11] Patent Number: 5,741,381

[45] Date of Patent: Apr. 21, 1998

[54] LABELLING SYSTEM AND METHOD

[75] Inventors: Dale E. Dolence, Evansville, Ind.; Roger Williams, Sr., Ellenwood, Ga.

[73] Assignee: R. W. Packaging, Inc., Monroe, Ga.

[21] Appl. No.: 650,259

[22] Filed: May 22, 1996

Related U.S. Application Data

[63] Continuation of Ser. No. 1,279, Jan. 7, 1993, abandoned.

[51] Int. Cl.[6] ..... B32B 31/00

[52] U.S. Cl. ..... 156/64; 156/215; 156/256; 156/277; 156/354; 156/355; 156/521; 83/363; 83/371

[58] Field of Search ..... 156/215, 250, 156/256, 277, 289, 354, 355, 361, 517, 521, 64; 83/361, 362, 363, 370, 371

[56] References Cited

U.S. PATENT DOCUMENTS

| | | | |
|---|---|---|---|
| 1,696,329 | 12/1928 | Saatman . | |
| 1,922,767 | 8/1933 | Humphner . | |
| 1,986,039 | 1/1935 | Ackley . | |
| 2,214,096 | 9/1940 | Weiss . | |
| 2,347,445 | 4/1944 | Von Hope . | |
| 2,613,168 | 10/1952 | Totten, Jr. . | |
| 3,045,643 | 7/1962 | Mattingly et al. . | |
| 3,542,229 | 11/1970 | Waltenhofen et al. . | |
| 3,657,043 | 4/1972 | Ploetz et al. . | |
| 3,955,020 | 5/1976 | Cavanagh et al. . | |
| 4,027,426 | 6/1977 | Wallding et al. . | |
| 4,121,961 | 10/1978 | Burnette et al. . | |
| 4,253,899 | 3/1981 | Takemoto et al. | 156/277 |
| 4,273,816 | 6/1981 | Tollette | 156/277 X |
| 4,314,869 | 2/1982 | Crankshaw . | |
| 4,361,260 | 11/1982 | Hanlan . | |
| 4,406,721 | 9/1983 | Hoffmann | 156/448 X |
| 4,519,868 | 5/1985 | Hoffmann . | |
| 4,567,681 | 2/1986 | Fumei . | |
| 4,574,020 | 3/1986 | Fosnaught . | |
| 4,629,528 | 12/1986 | Tanaka et al. . | |
| 4,735,668 | 4/1988 | Hoffmann et al. . | |
| 4,763,930 | 8/1988 | Matney . | |
| 4,931,122 | 6/1990 | Mitchell . | |
| 5,024,717 | 6/1991 | Winter | 156/354 |
| 5,037,499 | 8/1991 | Bright et al. . | |
| 5,045,140 | 9/1991 | Dickey . | |

FOREIGN PATENT DOCUMENTS 0441617 8/1991 European Pat. Off. .

OTHER PUBLICATIONS

Dow Chemical Company's *Technical Information* for Opticite 320 Film.

Dow Chemical Company's Technical Information for Opticite 350 Film.

Dow Chemical Company's *Technical Information* for Opticite 620 Film.

Pacific Scientific product literature for "Tough SC700 . . . One Tough Servo".

Pacific Scientific product literature for "SC750 Series".

Burr-Brown product literature for TM2500/TM2700 OEM Microterminals.

(List continued on next page.)

*Primary Examiner*—James Engel
*Assistant Examiner*—Paul M. Rivard
*Attorney, Agent, or Firm*—Woodard, Emhardt, Naughton, Moriarty & McNett

[57] ABSTRACT

The present invention discloses a labelling system and process. A continuous single-ply film is provided with a reverse printed image on an inside surface thereof with opaque coating substantially covering the inside surface. The film preferably is very thin, less than about 1.7 mils. The film is applied with a system using registration control based on two sources of input data, registration indicia and cutter position. The system self corrects for variations in true label length. An adhesive applicator is provided, such as a laser jet spray adhesive or alternatively a rotating cylinder having a cam surface which contacts the label with adhesive utilizing a perfectly cylindrical vacuum drum to avoid container/label slippage. A controlled motor drive on the supply roll to reduce web tension is provided.

25 Claims, 21 Drawing Sheets

OTHER PUBLICATIONS

Product literature for E.M.P. Model #2 Solid State Two–Way Preprint Registration Cut–Off Control Systems.

Lauricare™ Teat Dip Concentrate (34–7030–4074–0) Label (3M, St. Paul, Minnesota).

Coleman® 2 Leter Jug Label (5590C408) (Coleman Outdoor Products, Wichita, Kansas).

Zep® Reach Hand Cleaner Label (1288B) (Zep Mfg. Co., Atlanta, Georgia).

Original New York Seltzer® Raspberry Flavor Label (ZR–E913–MR1OBC 9 5) (New York Selzer Co., Walnut, California).

Clear Cola Crystal Pepsi® (7A–461) Label.

diet Coke Label (1991–2522 2L) (The Coca–Cola Company).

Sunny Delight® Orange Juice Label.

```
' ------------ Parameter Values Header ----------
PARAMS START
    POLECOUNT = -4
    ILC = 91
    SIX.THRESH = 4000.000000
    SIG.THRESH = 3600.000000
    KVP = 0.2
    KVI = 2
    ARF0 = 150.000000
    ARF1 = 175.000000
    KPP = 20.000000
    BLKTYPE = 2
    ILMT.PLUS = 100
    ILMT.MINUS = 100
    DACMAP = 1
    DMGAIN = 1.000000
    CMDGAIN = 1.000000
    ITF0 = 0.020000
    IT.THRESH = 60
    KVFF = 0.000000
    ADF0 = 1000.000000
    AD.OFFSET = 0.000000
    DMF0 = 1000.000000
    COMMOFF = 0.000000
PARAMS END
' ---------- Variable Definitions ----------
' for help put cursor on -> DIM <- and hit (F1) key
DIM LABEL_LENG AS FLOAT
DIM LABEL_RAT AS FLOAT
DIM BLANK_DIST AS FLOAT
DIM DUMMY AS FLOAT
DIM DUMMY2 AS FLOAT
DIM DUMMY3 AS FLOAT
DIM SAFE AS FLOAT
DIM ALTER AS STRING
DIM OFFSET AS FLOAT
DIM GRAB AS FLOAT
DIM LEARN AS FLOAT
DIM LEARN1 AS FLOAT
DIM LEARN2 AS FLOAT
DIM LEARN3 AS FLOAT
DIM EC_DIST AS FLOAT
DIM GRAB1 AS FLOAT
DIM GRAB2 AS FLOAT
DIM GRAB_OUT AS FLOAT
DIM FRD AS FLOAT
DIM COUNT AS INTEGER
DIM CALC AS INTEGER
DIM TOT AS INTEGER
DIM AVE AS INTEGER
```

Fig. 15a

```
DIM ANSWER AS INTEGER
DIM VERIFY AS FLOAT
DIM CONT AS FLOAT
DIM BUMP AS INTEGER
DIM TIM AS INTEGER
DIM RAT AS INTEGER
DIM VEL AS INTEGER
DIM CLN_PRT AS INTEGER
'--------- Main Program ---------
RESET:
ABORT.MOTION
LABEL_LENG = 0
LABEL_RAT = 0
BLANK_DIST = 0
DUMMY = 0
DUMMY2 = 0
DUMMY3 = 0
GRAB = 0
SAFE = 0
ALTER = " "
OFFSET = 0
GRAB1 = 0
GRAB2 = 0
COUNT = -1
CALC = 0
TOT = 0
AVE = 0
ANSWER = 0
BUMP = 0
TIM = 1
RAT = 1
VEL = 0

INTR.CHAR = 0
ENABLE = 1
AUTOSTART = 1
REG.MODE = 2
REG.DIST = 0
REG.FUNC = 1
'*********************************************************************
' THIS IS COSMETIC YET PROMPTS THE OPERATOR TO ENTER THE
'  LABEL LENGTH THAT IS TO BE RUN.
'*********************************************************************
COMMUNICATIONS:
    PRINT
    PRINT "R.W. PKG. / Z4000".
    PAUSE.TIME = 1.00
    PAUSE
    PRINT
    INPUT "FEED ROLL DIAM:", FRD
```

Fig. 15b

```
    PRINT
    INPUT "EYE-CUT DIST:", EC DIST
    PRINT
    PRINT "THANK YOU !",
SET_UP:
'*********************************************************************
' THIS IS THE PRELIMINARY SET UP PRIOR TO THE MAIN PORTION OF
' THIS PROGRAM.
'*********************************************************************
LEARN = 987654321

ENABLE = 1
ACCEL.TYPE = 0
ACCEL.RATE = 50000
DECEL.RATE = 50000
RUN.SPEED = 25
DIR = 0
GO.VEL

WHEN INP1 = 1, ABORT.MOTION
PAUSE.TIME = .5
PAUSE
POS.COMMAND = 0
ANSWER = 0

PAUSE.TIME = .5
INTR.CHAR = 1
PRINT
PRINT "YES-TO TELL WIN",
PAUSE

GO.VEL
WHILE ANSWER = 0 : WEND
ABORT.MOTION
WHILE IN.POSITION = 0 : WEND
BLANK_DIST = POS.COMMAND
PRINT
PRINT "WINDOW SET".
PAUSE
ANSWER = 0

GO.VEL
PRINT
PRINT "LOOKING FOR MARK".
WHEN INP1 = 1, ABORT.MOTION
PRINT
PRINT "IS THIS THE MARK".
WHILE ANSWER = 0 : WEND
    IF ANSWER = 1 THEN
       GOTO CONT
```

Fig. 15c

```
    ELSE
      PRINT
      PRINT "PROG. STOPPED".
      PAUSE
      PRINT "RESETTING PROG",
      PAUSE
      GOTO RESET
    END IF
CONT:
    PRINT
    PRINT "CONT PROGRAM",
    GRAB1 = POS.COMMAND
    grab2 = frd * 3.141593
    grab2 = grab2 / 16403
    grab2 = grab1 * grab2
    PRINT "LABEL=",GRAB2,
    PAUSE.time = 2
    pause
    ANSWER = 0

    LABEL_LENG = POS.COMMAND

    IN.POS.LIMIT = 5

    ENC.IN = 1000
    LABEL_RAT = LABEL_LENG / 4096
    RATIO = -LABEL_RAT
'*********************************************************************
' THIS BEGINS THE MOTION OF THE FEEDER TO LOCATE THE
' REGISTRATION MARK.
'*********************************************************************
    ENABLE = 1
    ACCEL.TYPE = 0
    ACCEL.RATE = 50000
    DECEL.RATE = 50000
    POS.COMMAND = 0
'*********************************************************************
' THIS CALCULATES THE OFFSET TO INDEX THE REGISTRATION MARK
' TO THE PROPER POSITION IN RELATION TO THE CUTTER KNIFE.
'*********************************************************************
    CONT = FRD * 3.141593
    EC_DIST = EC_DIST /CONT
    EC_DIST = EC_DIST * 4
    EC_DIST = EC_DIST *4096
    OFFSET = EC_DIST / LABEL_LENG
    OFFSET = OFFSET - FIX(OFFSET)
OFFST:
    DUMMY2 = LABEL_LENG * OFFSET
    PRINT
    PRINT "SET E_C DIST.".
```

Fig. 15d

```
    INDEX.DIST = DUMMY2
    GO.INCR
    WHILE IN.POSITION = 0 : WEND
'*********************************************************************
' THIS IS A TRAP TO WAIT FOR A START SIGNAL.
'*********************************************************************
    ENCPOS = 0
    INTR.CHAR = 1
PAUSED:
    GEARING = 0
    WHILE IN.POSITION = 0 : WEND

    PRINT
    PRINT "PAUSED",

    WHILE INP2 = 1
    GEARING = 0
    WEND

    INDEX.DIST = 0
    GEARING = 1
    GO.INCR
    PAUSE.TIME = .1
    PAUSE

    IF LEARN > = 3 THEN INDEX.DIST = -1
    IF LEARN = 987654321 THEN INDEX.DIST = 2
    IF LEARN = 1 THEN INDEX.DIST = 0

    GO.INCR

    LEARN = 0

    PRINT
    PRINT "RUNNING",
'*********************************************************************
' INTERRUPT IS INITIATED AND FOLLOWING BEGINS.
'*********************************************************************
    GOTO MAIN
CALCULATIONS:
    DUMMY = DUMMY3 * 1.024 * LABEL RAT
    DUMMY = FIX(DUMMY)
    CLN_PRT = INT(DUMMY)
    PRINT
    PRINT "CORR. = ": CLN PRT.
      IF DUMMY > 40 THEN
            LABEL_RAT = LABEL_RAT * 1.001
            VEL = VEL + 1
            PRINT
            PRINT "RAT. CHG. # ": VEL.
```

Fig. 15e

```
        END IF
        IF DUMMY < -40 THEN
            LABEL_RAT = LABEL RAT / 1.001
            VEL = VEL – 1
            PRINT
            PRINT "RAT. CHG. # ": VEL.
        END IF
        IF DUMMY > 120 THEN
            DUMMY = 120
        END IF
        IF DUMMY < -50 THEN
            DUMMY = -50
        END IF
    REG.DIST = DUMMY
    ACCEL.RATE = 50000
    DECEL.RATE = 50000
    ACCEL.TYPE = 1
    INDEX.DIST = DUMMY
    GO.INCR
MAIN:
    LEARN = LEARN + 1
    RATIO = -LABEL_RAT
    WHILE POS.COMMAND < BLANK_DIST
    IF INP2 = 1 THEN GOTO PAUSED
    WEND

    REG.FLAG = 0
    INTR.CHAR = 0
    WHILE REG.FLAG = 0
    IF INP2 = 1 THEN GOTO PAUSED
    WEND
    POS.COMMAND = 0
    INTR.CHAR = 1
    GRAB = REG.ENCPOS
    IF TIM = 1 THEN
        ENCPOS = (-4000 – REG.ENCPOS) + REG.ENCPOS
        TIM = 0
    END IF
    GRAB = GRAB / 4000
    GRAB = ABS(GRAB)
    DUMMY3 = GRAB – FIX(GRAB)
    IF DUMMY3 > .5 THEN
        DUMMY3 = DUMMY3 – 1
    END IF
        DUMMY3 = DUMMY3 * 4000
    GOTO CALCULATIONS
END ' Main Program
'----------Subroutines ----------------

'----------Interrupt Routines ---------
```

Fig. 15f

```
INTERRUPT CHAR

    ALTER = " "
    ALTER = UCASE$(INKEY$)

    IF ALTER = "A" THEN
       INDEX.DIST = 30
       GO.INCR
       ENCPOS = ENCPOS - 30
       PRINT
       PRINT "INDEX FORWARD".
    ELSE IF ALTER = "B" THEN
       INDEX.DIST = - 30
       GO.INCR
       ENCPOS = ENCPOS + 30
       PRINT
       PRINT "INDEX BACK".
    ELSE IF ALTER = "C" THEN
       INDEX.DIST = 150
       GO.INCR
       PRINT
       PRINT "ADVANCE 150".
    ELSE IF ALTER = "D" THEN
       INDEX.DIST = - 75
       GO.INCR
       PRINT
       PRINT "RETARD 75",
    ELSE IF ALTER = "E" THEN
       ANSWER = 1
    ELSE IF ALTER = "F" THEN
       IF INP2 = 1 THEN
              GEARING = 0
              PAUSE.TIME = 2
              PRINT
              PRINT "PROG. STOPPED",
              PAUSE
              GOTO RESET
       END IF
    END IF

    INTR.CHAR = 1

    ALTER = " "

END INTERRUPT

'----------End of Program Listing ----------
```

Fig. 15g

LABELLING SYSTEM AND METHOD

This application is a continuation of application Ser. No. 08/001,279, filed Jan. 7, 1993, now abandoned.

BACKGROUND OF THE INVENTION

The present invention relates generally to a labelling system and method, and more specifically according to one aspect relates to a single-ply labelling for containers such as PET bottles and the like.

In the field of soft drink container labelling, such as labelling of the cylindrical portion of a polyethylene teraphthalate (PET) bottle having a cylindrical side wall, the most common type of label is a two-ply label. The first ply is generally opaque (typically white) which is printed with the labelling indicia, with a second ply of transparent film bonded thereover. The opaque base layer typically is either paper or plastic, with the label wrapped and adhered to the side wall of the bottle. Other single-ply labels (typically made of paper) with outside surface printing have also been used.

Other single-ply labels have been used on products in which a single-ply of transparent film is reverse printed on the inside of portions of the label while leaving other portions of the label transparent, allowing visual inspection of the contents of the container and/or the appearance of a partially wrapped label. Insofar as the present inventors are aware, such labels are either shrink-wrap sleeves or discrete labels having pressure sensitive adhesive and mounted on a peel-away backing, such as paper.

While the foregoing labels have, in certain circumstances, provided satisfactory results, they have various shortcomings. It is desirable to provide a label which provides top quality aesthetic appeal (such as for consumer products) while providing substantial cost savings to the manufacturer. Furthermore, it is desirable to provide these advantages while also providing a label which is durable during transport and storage. The present invention provides these advantages.

Moreover, labelling processes and machinery presently available are not entirely satisfactory for a high speed labelling operations of highly elastic and/or fragile webs, such as the single-ply labelling according to the present invention. Such labels may be manufactured on a film having a thickness of one rail. Although beneficially this greatly reduces material costs and reduces down-time in the machinery since more labels are available in a given size roll of labels, other challenges such as registration control, adhesive application and stress control arise. These problems are compounded when labelling operations are at high speeds.

The present invention likewise addresses and solves these problems. The present invention provides registration control system requiring only two inputs, an optically sensed registration indicia input and a cutter position input. Moreover, utilizing such input in the present invention monitors and "learns" label characteristics, namely label length, present in a given roll of labels being run. In this way, the system automatically accommodates for fluctuations in label length due to factors such as printing tolerance variations, thermal expansion, mechanical stretching, roll slippage and the like. Such factors, and especially printing tolerance factors, my be present at the splice interface between two rolls being connected in a series to maintain the labelling operation running continuously. The present invention automatically monitors and accommodates for such fluctuations by determining whether registration variations exceed a threshold value, and if they do, modifying a computer established base label length/label feed rate accordingly. Furthermore, minor registration variations falling beneath the threshold valve are intermittently corrected. Preferably, such corrections are made ratiometrically or with other programmed limits, thereby dampening registration convections to reduce instantaneous stress and strain exerted on the web.

Moreover, the present inventive label lends itself to convenient and economical providing of registration indicia on the inside surface of the label film, unlike prior non-backed labels. Such indicia may comprise a printed registration mark or merely the absence of print (i.e. a transparent window) with uninterrupted blank area on the inside surface of the label between the indicia. Such arrangement allows for higher speed operation of the labelling system and method without losing registry since false indicia (e.g. from label print), which otherwise need to be disregarded by the sensor, are not present.

The foregoing label, system and method further is enhanced by an improved adhesive application system according to the present invention. Conventional prior devices utilize a vacuum drum to wall the labels past a glue applicator roller and wrap the labels around a container. Raised surfaces on the vacuum drum underly the label on the leading and trailing edges so the label contacts the glue applicator roller. However, such raised surfaces result in a vacuum drum which is not a true cylinder. Accordingly, as the vacuum drum wraps the label around the container, fluctuations in the spacing between the vacuum drum and the curved wall guiding the container cause intermittent slippage in the rotation of the container and label, resulting in slack between the label and the container. Moreover, such arrangement requires replacement or modification of the vacuum drum if labels of different length are desired to be run on the labelling system. Other designs have been proposed to have a vacuum drum with raised surfaces which intermittently extend and retract so as to provide adhesive contact while not causing the aforementioned spacing problems. The present invention simply alleviates these problems by providing a true cylindrical vacuum drum and providing a synchronously timed adhesive applicator, such as to provide adhesive along leading and trailing edges of a label. Accordingly, synchronous control of such applicator may be easily modified, such as with a computer program, to allow labels of different length and width to be run. Such glue applicator may include a rotating cylinder having raised surfaces which synchronously contact the appropriate leading and trailing edges with a glue applicating member; or, alternatively may comprise a movable adhesive jet spray applicator.

BRIEF DESCRIPTION OF THE DRAWINGS

FIGS. 15*a*–15*g* illustrate, sequentially, one embodiment of a computer program according to the present invention for the system illustrated in FIG. 14*a*–14*c*.

SUMMARY OF THE INVENTION

Figure 1:
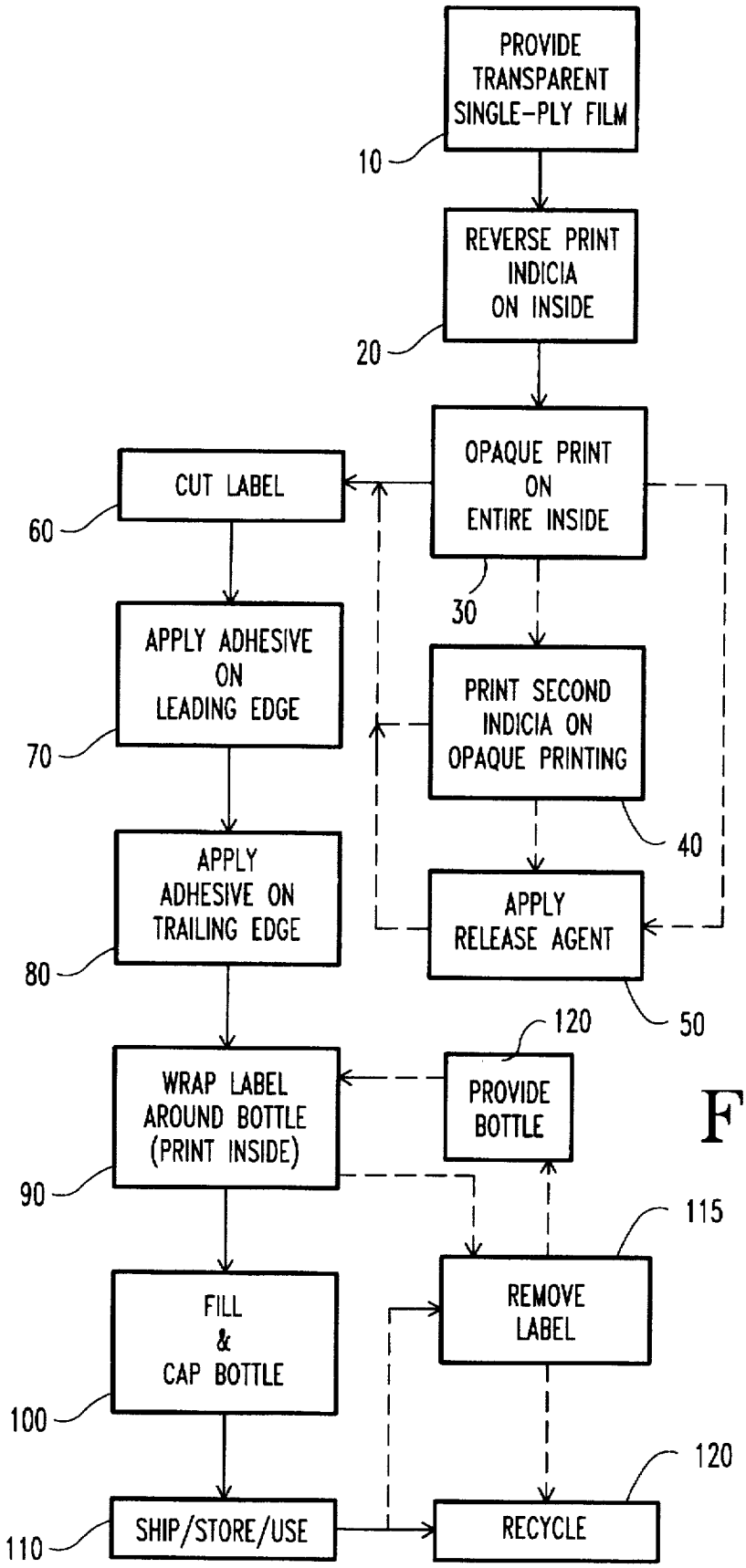
FIG. 1 is a schematic flow chart of a first embodiment of the present inventive process.

According to one embodiment, the present invention provides an elongated flexible label base consisting essentially of a single-ply transparent film having an inside surface and an opposite outside surface. The film has a series of printed images on the inside surface of the film which are reverse printed in a mirror image of the images to be displayed on the container. A substantially opaque coating is printed over the inside surface of the film at least on portions not printed with the image. Essentially all of the inside surface of the transparent film is coated with a print coating to provide substantial opacity across entirely all of the label.

According to to another embodiment, the present invention provides a process for labelling the aforementioned film and wrapping adhering labels cut from said elongated flexible label base around an outside surface of the container. The reverse printed images are located between the transparent film of the container and are viewable through the single-ply film as the displayed image. The opaque coating obstructs viewing of the container through the film.

According to another embodiment, the present invention provides a system for labelling a series of containers, comprising a supply roll and a cutter for cutting labels. A rotating vacuum drum has a working surface which is cylindrical free from raised surfaces. An applicator for providing adhesive is provided having means for selectively applying said adhesive only to selected portions of the inside surface of the labels. The means for applying an adhesive is synchronized with the position of corresponding labels on the rotating vacuum drum. A container supply provides a series of at least partially cylindrically shaped containers and the labels are wrapped at least partially around a corresponding container.

According to another embodiment, the present invention provides a system for labelling, comprising a supply roll comprising a winding of an elongated flexible label base having printed images therealong; and, a label applicator for labelling containers including: a first motor drive for driving the label base through a cutter; roll; a rotating drum receiving labels; and, a variable speed second motor drive separate from the first motor drive and coupled to rotate and unwind the supply roll, whereby tensile stress and strain in the flexible label base is reduced.

According to another embodiment, the present invention provides a system for labelling a series of containers with labels providing images to be displayed, comprising a supply roll of an elongated flexible label base having images thereon; a rotating drum; and, a feed roller between the supply roller and the rotating drum. The feed roller has a working surface contacting the label base and further has means for pulling a vacuum on the working surface to draw the label bases thereon.

According to another embodiment, the present invention provides a process for providing cut labels for labelling a series of containers, comprising the steps of providing an elongated flexible label base including registration indicia thereon; passing the label base through means for sensing the registration indicia and through a cutter; and sensing input data from two sources. The input data includes sensing a first registration indicia and a second registration indicia, and sensing a cutter position, and providing such information to digital means for processing data. The process includes calculating a first label length; driving a controlled speed motor at a first base feed rate; determining an anticipated location of third registration indicia; sensing said third registration indicia to provide actual third location data; comparing the anticipated actual location of the third registration indicia; modifying the first calculated label length based on the first registration variance to establish a calculated second label length; modifying the first base feed rate to a second base feed rate; and, sequentially cutting singular labels with the cutter.

According to another embodiment, the present invention provides a system for labelling a series of containers with labels, comprising a supply roll with an elongated flexible label base having an inside surface and an opposite outside surface and further having a plurality of sequenced printed images viewable along the outside surface, wherein the elongated label base comprises a continuous elastic polymeric film having a thickness less than about five mils; a rotating drum receiving labels thereon and applying cut labels to corresponding series of containers; a cutter; and, a controlled speed motor responsive to signaling means for processing to maintain registry. The label base has a series of registration indicia which are machine readable along the inside surface of the label base; and means for scanning the registration indicia are provided positioned along the inside surface.

One object of the present invention is to provide improved labelling material. Another object of the present invention is to provide an improved labelling system and method. Another object of the present invention is to reduce labelling cost and to increase labelling speed. Another object of the present invention is to improve labelling machine registry control and accuracy. Another object of the present invention is to provide an improved adhesive applicator. These and other objects and advantages of the present invention will become apparent from the present written description and drawings.

DESCRIPTION OF THE PREFERRED EMBODIMENT

For the purposes of promoting an understanding of the principles of the invention, reference will now be made to the embodiments illustrated in the drawings and specific language will be used to describe the same. It will nevertheless be understood that no limitation of the scope of the invention is thereby intended, such alterations and further modifications in the illustrated device and process, and such further applications of the principles of the invention as illustrated therein being contemplated as would normally occur to one skilled in the art to which the invention relates.

FIG. 1 illustrates a flow chart of process steps, with the preferred embodiment sequence illustrated with solid arrows and various alternative functions shown in dotted-line arrows. Initially, a transparent, single-ply film is provided at step 10. Such film is described further below as film layer 21. Step 20 illustrates that transparent film layer 21 is reverse printed with print indicia 22 along its inside surface 21*a* (see FIGS. 2*a* and 3). Indicia 22 may be lettering, trademarks, logo, bar codes, art work and any other print design. Thereafter, step 30 illustrates opaque print being printed on the entire inside surface 21*a* of film layer 21. Opaque print 23 is preferably printed across the entire back surface, or least substantially the entire back surface, although may be selectively printed interstitially between the printing indicia 22. However, for simplistic purpose it is easier to simply print a layer 23 across everything, including indicia 22. Optionally included within step 30 is the printing of a second opaque layer 24. Layer 24, like layer 23, typically consists of white ink. Alternatively, layer 23 may be singularly printed and/or printed in a thicker layer depending on the degree of opacity desired. Transparent film 21 preferably has a high degree of clarity and light transmission. Preferably the HAZE value of such single-ply film is less than 30%, and more preferably is less than about 25%, with commercially available films having between about 12% and 25% haze providing good results. However, label 11 including the opaque back printing 23 and/or 24 should have substantial opacity across substantially its entire surface area. Preferably, after the printing of at least printing 23, the average opacity through the label should be at least about 60% white light absorbtion/reflection (i.e. not more than 40% white light transmission), and more preferably the white light absorbtion/reflection value should exceed about 75% to 80%. It has been found that with a high solids white ink for print 23, white light absorbtion/reflection ranging between about 80% and 85% may be achieved with good results.

Figure 2A:
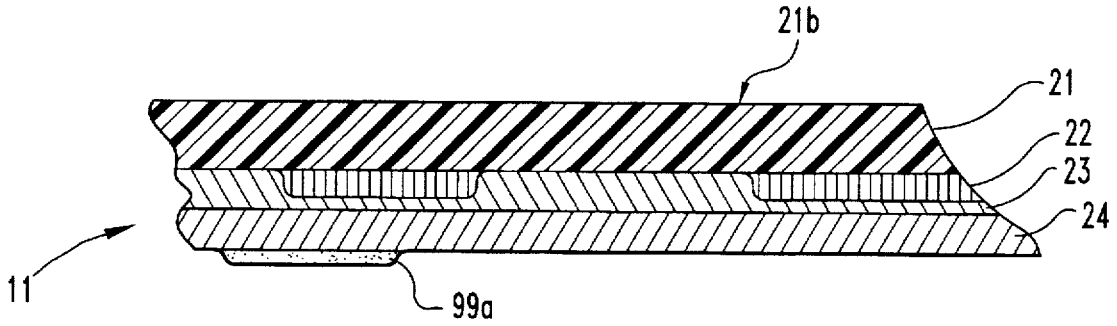
FIG. 2*a* is a partially cutaway cross sectional view of a preferred embodiment of labelling material according to the present invention.
Figure 2B:
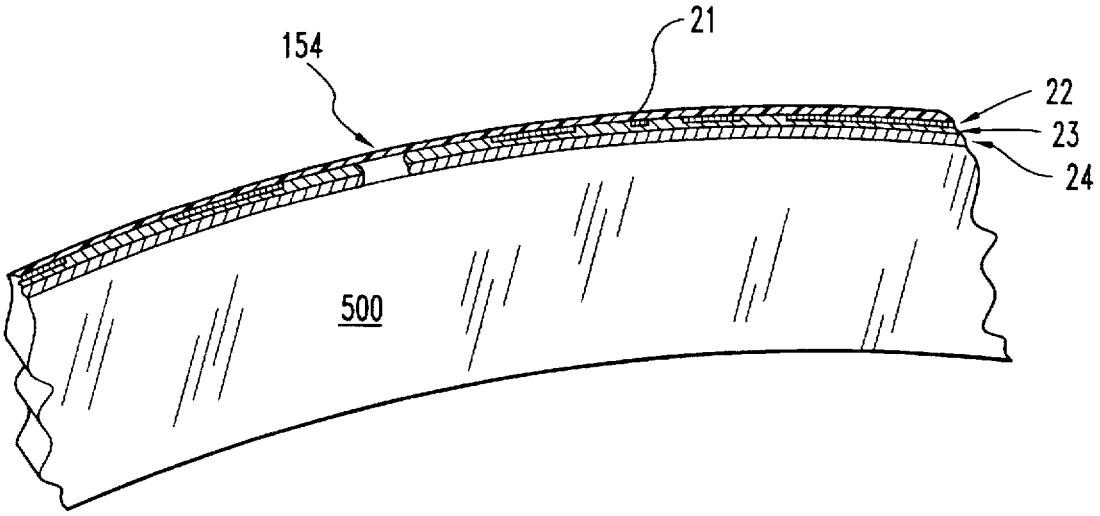
FIG. 2*b* is a partially cutaway cross sectional view of the labelling material illustrated in FIG. 2*a* on a container wall.
Figure 3:
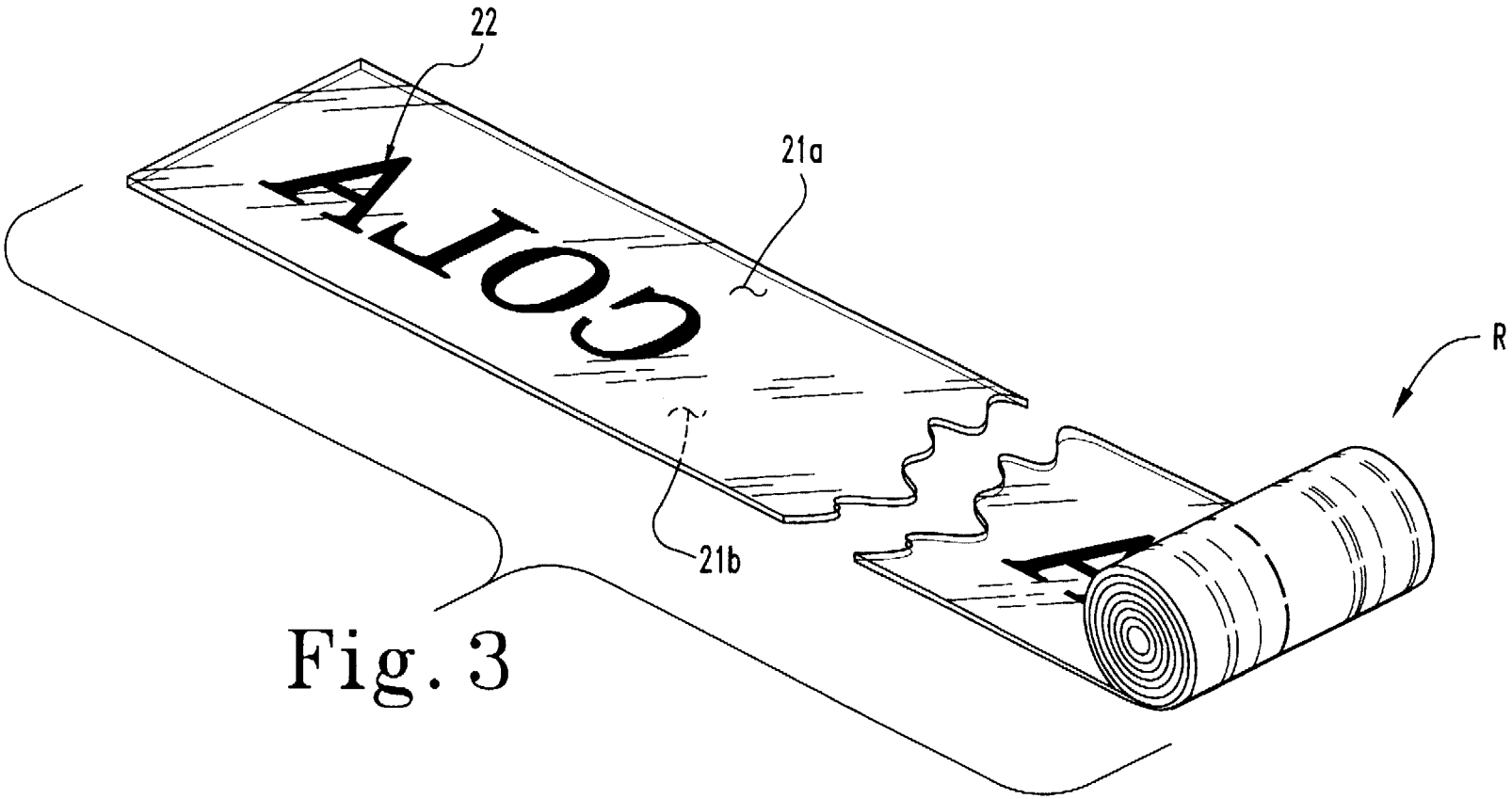
FIG. 3 is a perspective view of single-ply roll and label film reverse printed on its inside surface in a mirror image of the image to be displayed on a container.
Figure 4:
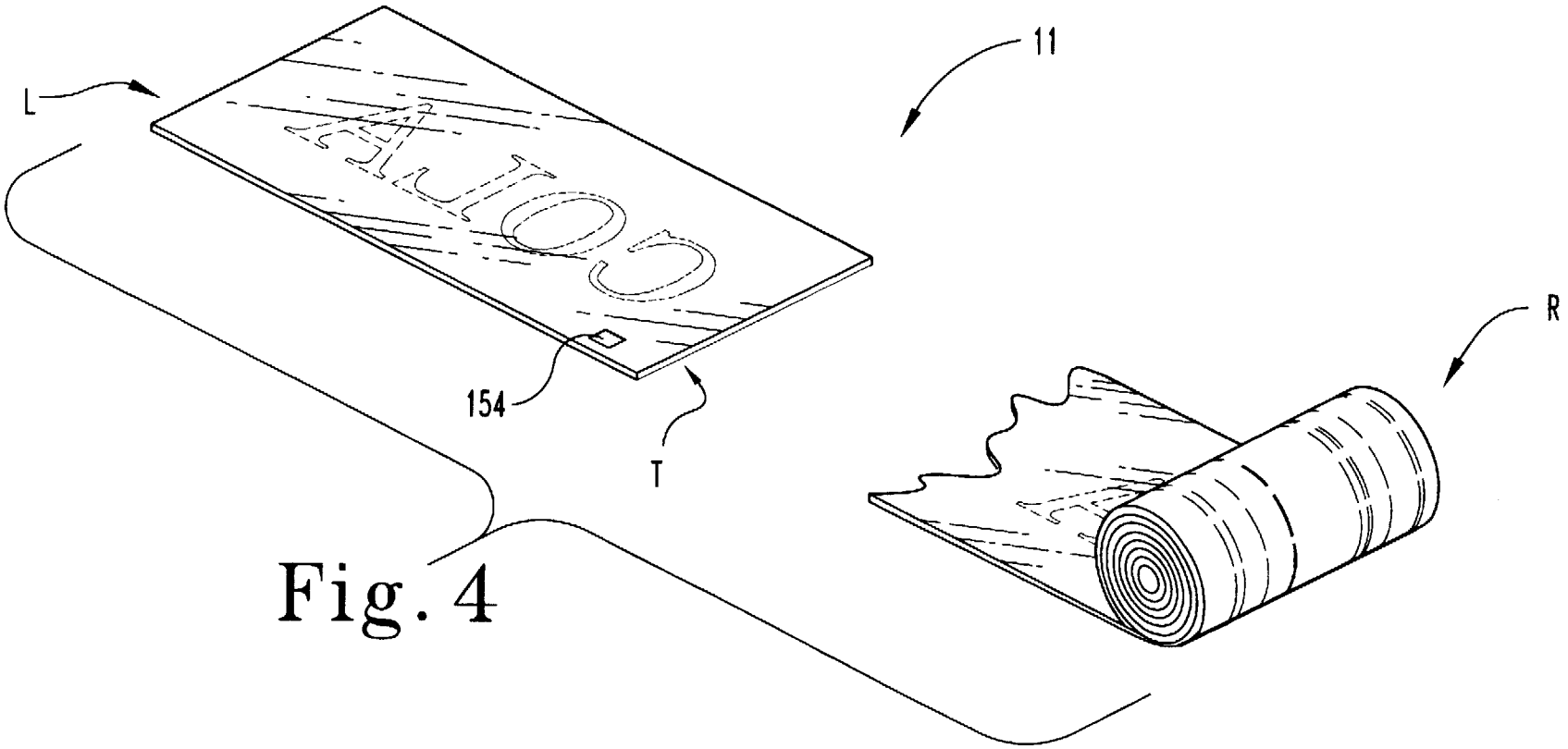
FIG. 4 is a perspective view of the roll and label of FIG. 3 having substantially opaque printing along an inside surface thereof.
Figure 5:
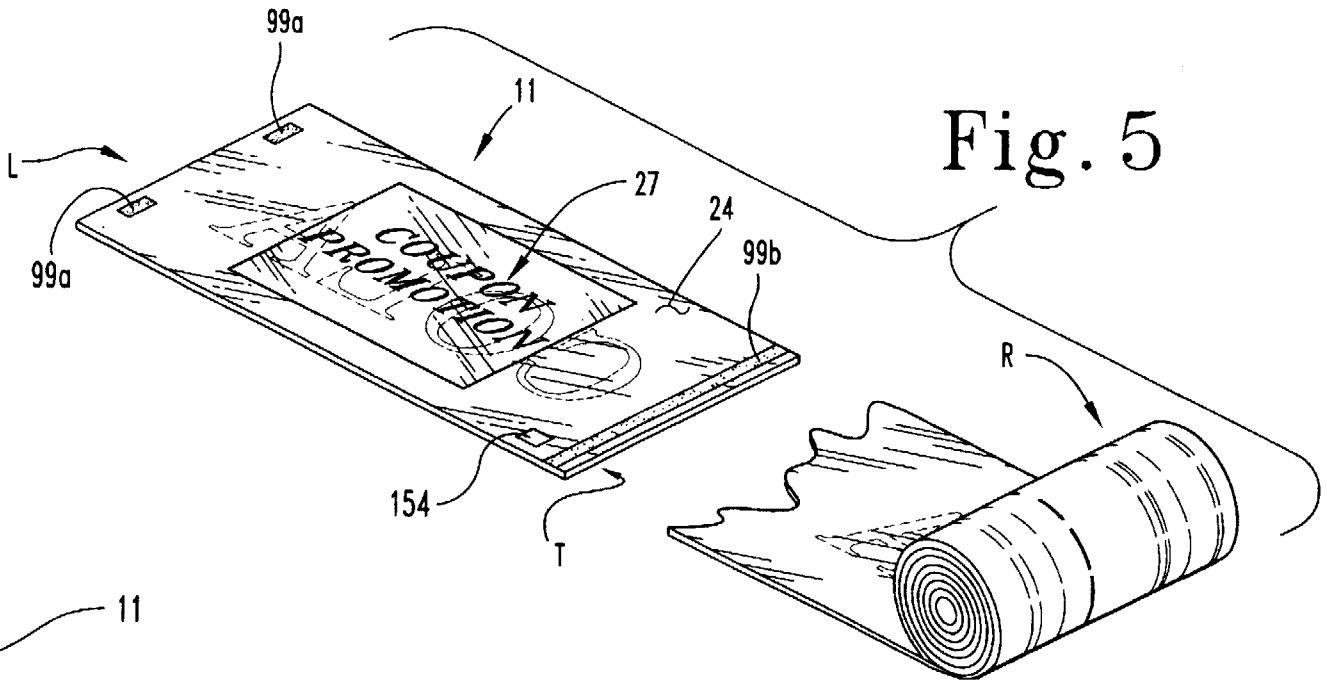
FIG. 5 is a perspective view of the roll and label of FIG. 4 including the optional feature of a second indicia printed over the back of the opaque coating.
Figure 7:
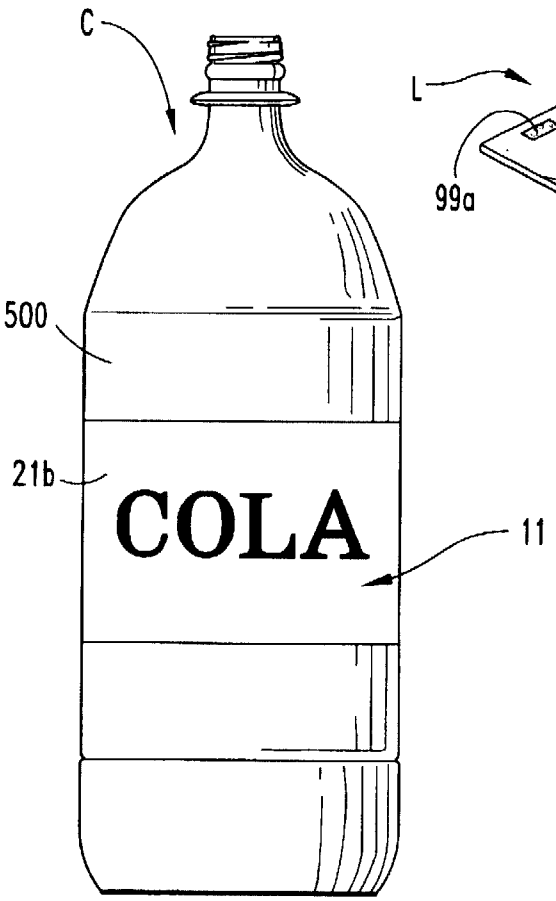
FIG. 7 illustrates a side view of a container bottle labelled according to the present invention.
Figure 14:
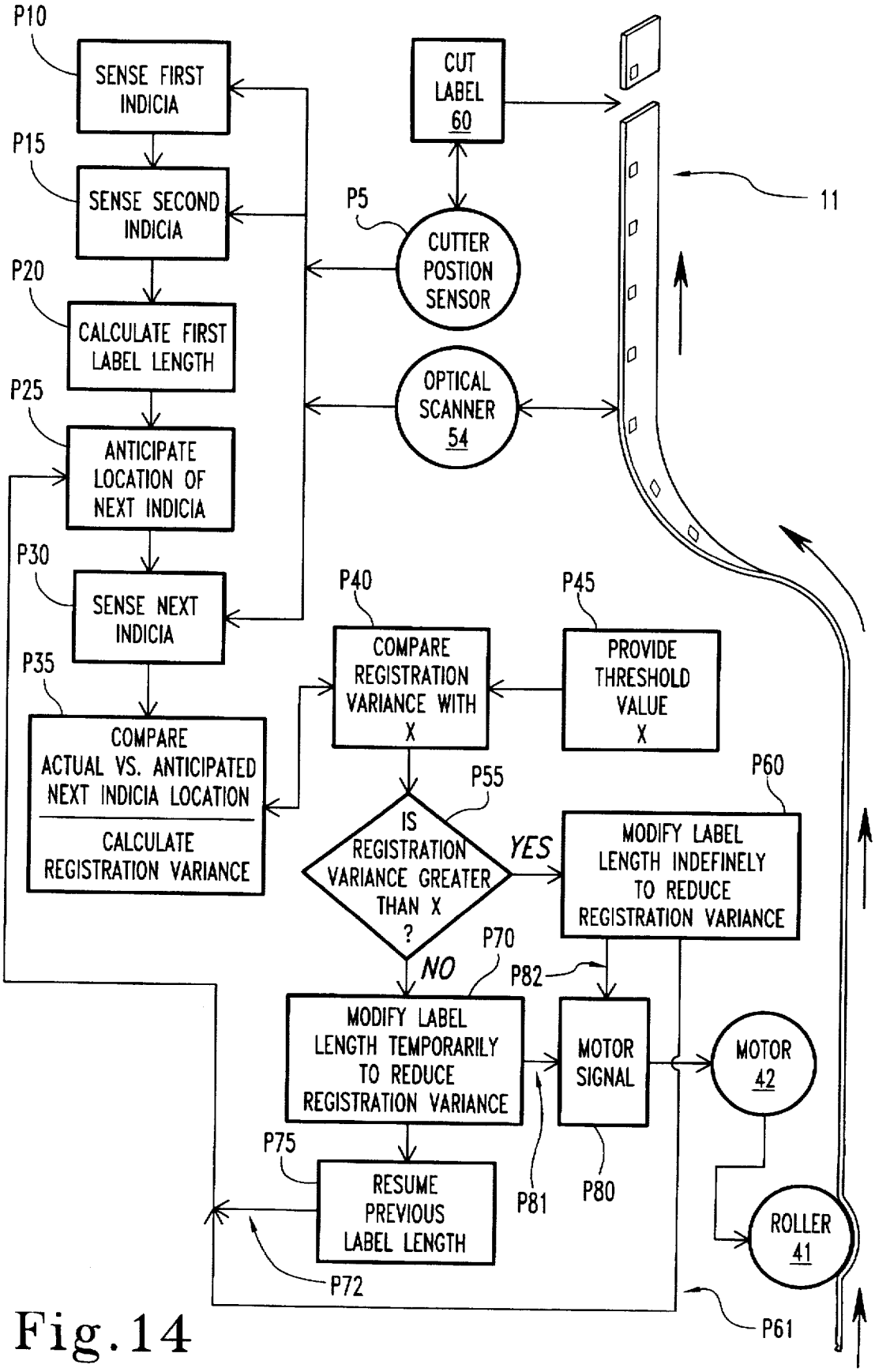
FIG. 14*a* is a logic flow chart of a preferred embodiment of the registration control system for a cutter of the present invention.
FIG. 14*b* is a logic flow chart of a set-up procedure for the logic flow chart of FIG. 14*a*.
FIG. 14*c* is a partial logic flow chart insertable as an alternative to a portion of the flow chart of FIG. 14*a*.
Figure 14A:
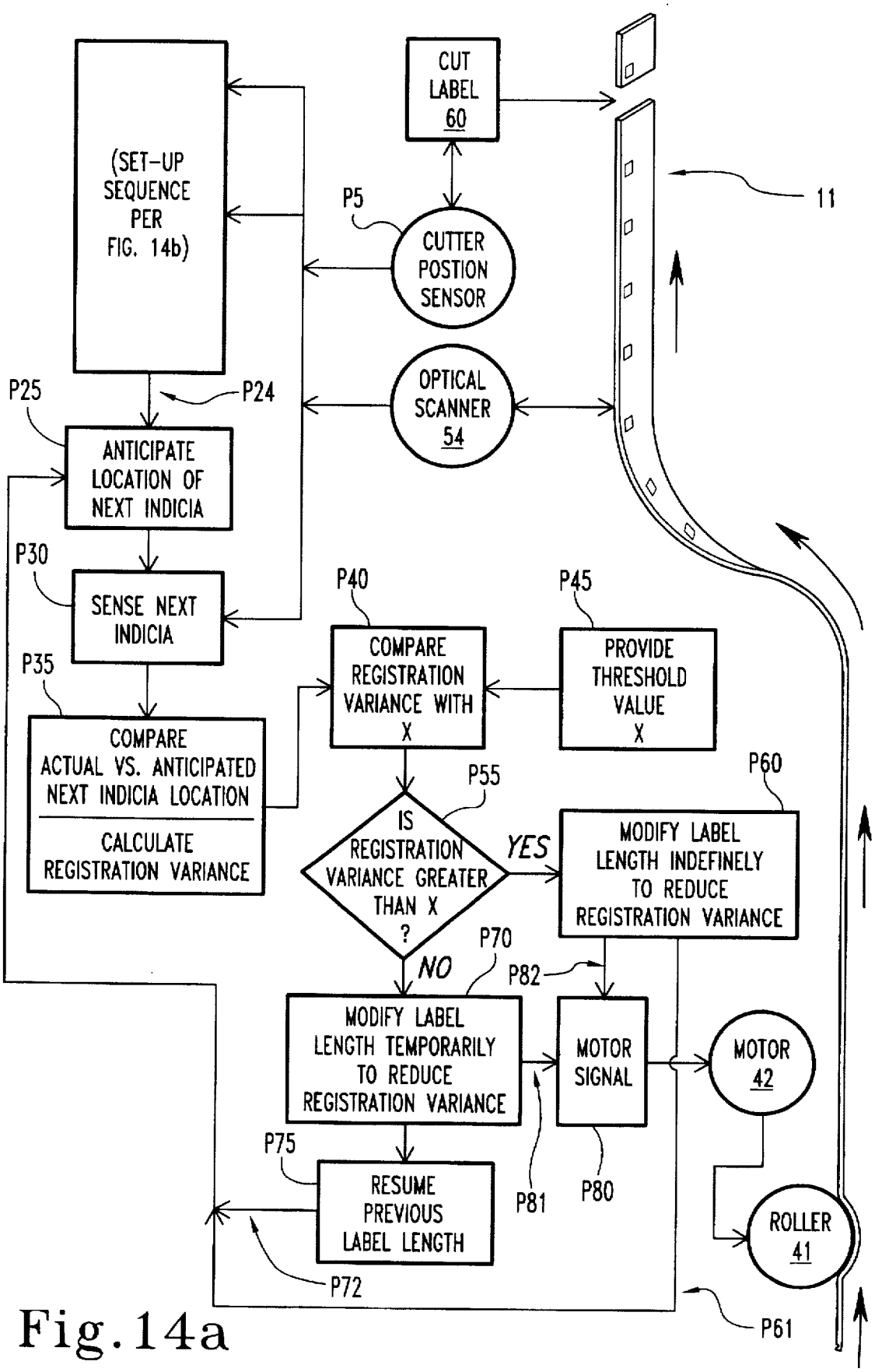

Optional step 40 comprises printing a second indicia on the inside surface of the opaque printing layers 23 and 24. Such optional feature is illustrated as print indicia 27 in FIG. 5, shown as a coupon or promotion. Other print indicia may be included either for reading after removal of the label or reading upon viewing of indicia 27 through a transparent container from the back side. The second indicia printing of step 40 may include indicia 154 (see FIGS. 4, 5, 9, 14*a*). Indicia 154 is a registration indicia located on the inside surface of label 11 opposite outside surface 21*b* of the label. Alternatively, rather than being a printed indicia, 154 may comprise a transparent window formed by leaving an area not printed with indicia 22, opaque coating 23, or opaque layer 24 so that a transparent window through film layer 21 remains as illustrated in FIGS. 2*b* and 14*a*. Either of these forms of indicia, according to one aspect of the present invention, provide a novel position in form of indicia on a roll R of a continuous, elongated label base which is unrolled and cut for wrapping onto containers, such as container C (see FIG. 7). Indicia 154 on the inside surface of the labels are located on a substantially blank (preferably white) back surface with no extraneous printing or other material other than the registration indicia. This avoids sending a false signal to indicia sensing mechanisms. As described further below, this enables operation of labelling machinery at higher speeds and greatly reduces or eliminates any risk of false indicia reading and improper registration cuts or other operations. Unlike prior surface printed labels or two-ply labels, the present reverse printed label, such as illustrated in FIG. 2*a*, are especially well suited for precise location of registration indicia 154 without requiring an additional printing run, such as when indicia 154 comprises a transparent window.

Optional step 50 (FIG. 1) comprises applying a release agent and a thin layer to the label, typically where the adhesive, such as adhesive regions 99*a* are to be applied. In this way, removal of the label, set forth in step 115 (FIG. 1) is facilitated for recycling or reprocessing of a container or using the label as a coupon.

After printing step 30, second printing step 40, and/or application release agent step 50 are completed, the roll of label is mounted on labelling machinery, as described further below, unwound and cut at step 60. The cutting step 60 may be performed in conventional machinery, such as B & H Manufacturing Machinery of Ceres, Calif., U.S.A., Model No. BH-2000 or other such machinery. However, it is preferred that such machinery be modified in accordance with the features of the present invention set forth further below.

Step 70 comprises applying adhesive on leading edge L, namely adhesive at locations 99*a*, and step 80 comprises applying adhesive on trailing edge T, such as adhesive strip 99*b*. Again, while such adhesive may be applied using various conventional approaches used in existing machinery, it is preferred that the present label have such adhesive applied in accordance with the principles of the adhesive application system and method described below. Moreover, adhesive application step 70 and 80 are not intended to be restrictive with respect to the processing of the label, it being understood that adhesive may be applied on other areas, including the entire inside surface of the label, where such application is warranted for particular end use.

Figure 6:
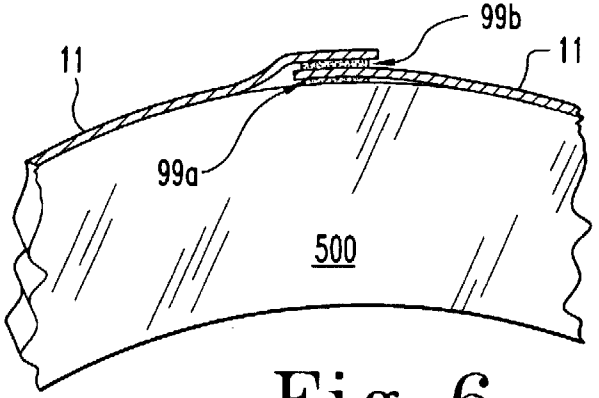
FIG. 6 is cross sectional view of the label and a container wall according to the present invention illustrating a lap joint.

Step 90 comprises wrapping the label around a bottle with the print inside, namely between single-ply transparent film layer 21 and container wall 500 as illustrated in FIG. 2b. In this way, film layer 21 serves a dual purpose of providing a support base for the print indicia as well as a protective covering to protect indicia 22 and coating 23 from scuffs or other wear which detracts from the cosmetic appeal of the label on the container. Such wrapping preferably is slightly in excess of 360° to provide a conventional lap joint (see FIG. 6) as is known. However, it is within the scope of the present invention to optionally provide partially wrapped labels as well.

In the event of a misregistered, miscut or otherwise unacceptable wrapping of the label, after step 90, an unsatisfactory product may be removed from the production line with the label removed at step 115, returning the unused bottle to the "provide bottle" step 120. Otherwise, the labelled container is filled and capped at step 100. One preferred application of the present invention is that container C be filled with a human consumable beverage, such as for example soft drinks including colas and the like. Thereafter, in step 110 the product is shipped, stored and used. Thereafter, preferably the empty container is recycled at step 120 either before or after removal of label 11 at step 115. Preferably transparent film layer 21 comprises a polymeric film which is well suited for recycling either alone or in combination with recycling of container wall 500.

Single-ply transparent film 21 preferably is thinner than conventional two-ply film labels extensively used in the industry. Specifically, it is preferred that such film be less than 5 mils, and note specifically preferably is less than 2 mils, and more specifically has a thickness in the range of 1.7 to about 1 mill or less. Such extraordinarily thin labelling film provides great advantages, while also creating difficulties which are addressed by other aspects of the present invention discussed below. The primary advantage of film layer 21 being so thin is that it translates into tremendous cost savings due primarily to reduced material costs and processing costs. The conventional two-ply label uses almost twice as much polymeric film, and further entails the additional processing steps and costs of laminating the two-plys of film together. Surface printed films in the prior art do not incur this problem, but are more susceptible to scuff and wear and tear, typically requiring a protective coating. Typically, such surface printed paper labels do not lend themselves nearly so well to recycling, and also since they usually are opaque do not lend themselves to a registration indicia on their inside surface. Moreover, the collective thickness of the printing on inside surface 21*a* from print layers 21, 23, 24, and optionally 27, typically are not in excess of 0.25 mils. Accordingly, the overall thickness of label 11 is greatly reduced, providing a further advantage that in a larger number of labels may be provided in a roll R of a given diameter. Accordingly, down time and/or splicing frequency on labelling machinery is reduced; shipping and storage costs are likewise reduced. Preferably film 21 comprises polymeric film such as polyethylene or polypropylene. However, other webs and films, such as more costly films having controlled shrink characteristics like polystyrene, polyurethane or polyester or may be used. One film material which has been tested successfully includes a polyethylene film offered by Union Camp. Such film using ASTM test procedure D 882-80A had tensile strength characteristics of MD Break (PSI) of approximately 3,400 with a percent elongation of approximately 440; a TD Break (PSI) of approximately 2,000; an. MD Yield (PSI) of approximately 2,600; and, a TD Yield (PSI) of approximately 3,000. Preferably, the present invention is used with low cost generally non-oriented or low-oriented films having elongation shrink characteristics which are not well suited for controlled heat shrink applications. Such "non-shrink films" (i.e. those which shrink too much for controlled shrink labelling of containers) typically shrink more than about 10% to 15% in either a lateral or longitudinal direction when heated between about 150° F. and 210° F.; whereas, shrink films typically shrink about 5% at those temperature ranges. Such non-shrink single-ply films, such as polyethylene or polypropylene, provide lower cost as compared with more expensive bidirectional shrink films.

Selection of inks for printing label 11 are not deemed critical to the present invention, but for illustration purposes a preferred opaque layer 23 and/or layer 24 ink comprises PROFILE ink offered by J & B Ink Specialists company of Richmond, Va., U.S.A. A preferred use of the present invention is in combination with polyethylene teraphthalate (PET) containers, although it is to be understood that the present invention may be used with other containers, including various plastics, glasses and metals. Preferably, roll R of labels comprises at least 1,000 labels to be cut therefrom, and more preferably in excess of 5,000 labels, and even more preferably in excess of 10,000 labels in a single roll. One exemplary label length for label 11 is fourteen inches with industry standard printing tolerances of plus or minus 1/32 of an inch. The preferred roll has a diameter of about eighteen or nineteen inches comprising in excess of 140,000 inches of about 0.0017 inch thick labelling (e.g. 10,000 fourteen inch labels), and preferably about 160,000 inches of such labelling. The unique thin film of the present invention allows for a greater number of rolls per label than thicker two-ply films or thicker heat shrink films. Naturally, other label sizes may be used as various applications require.

Figure 8:
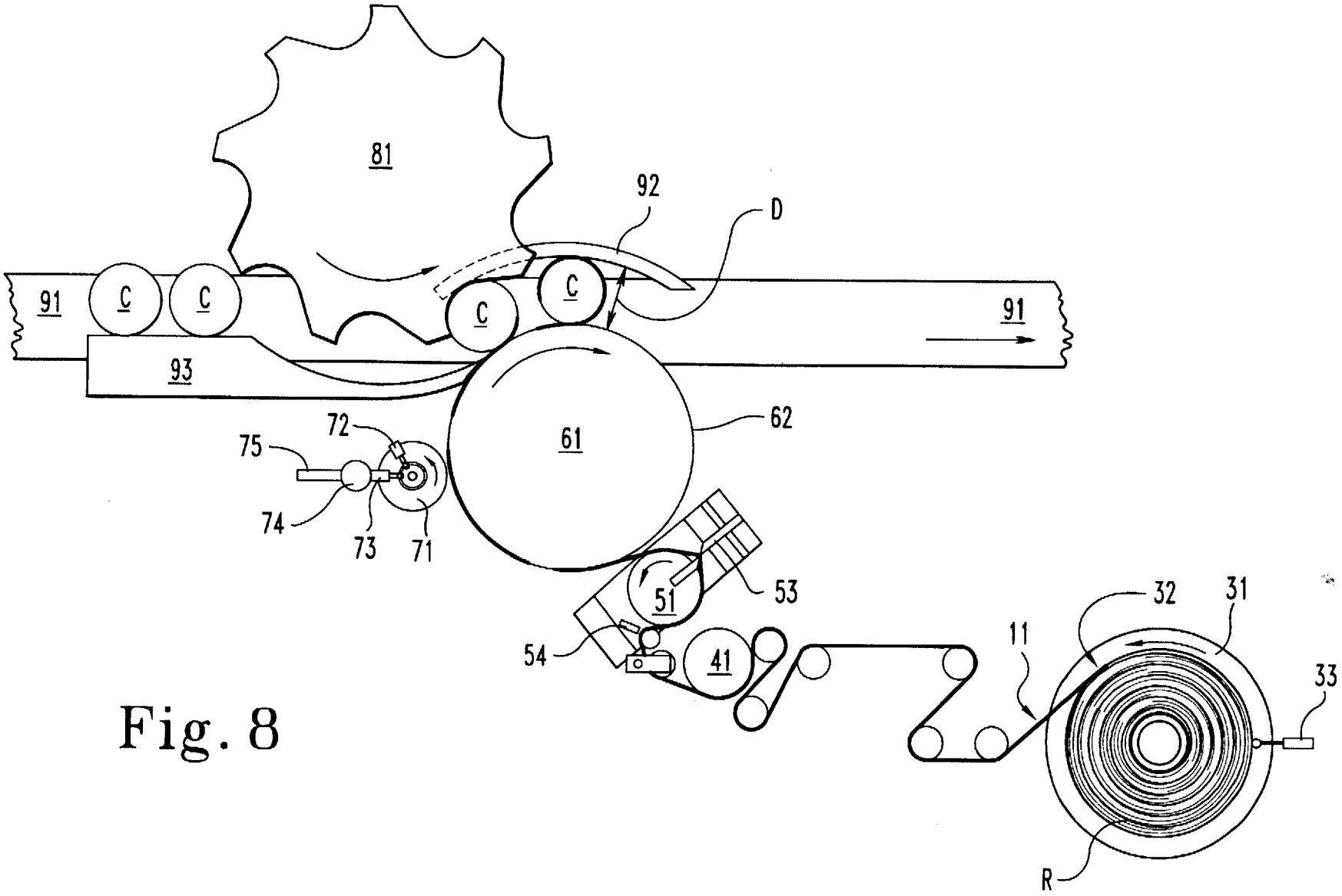
FIG. 8 is a top plan view of a labelling system according to the present invention.

FIG. 8 illustrates a preferred embodiment of a system employing a method according to the present invention. The illustrated machinery comprises a B & H Manufacture Model No. BH-2000 machine well known in the industry but modified in accordance with the present invention. Label 11 is supplied from the continuous roll of labels R sitting atop the supply roll table 31. The label is thread through a series of rollers and tensioners as illustrated and drawn by feed roller 41 in connection with a pinch roller illustrated in tangent contact therewith. After the feed roller, label 11 passes a scanner or sensor 54. Preferably, this is an optically scanner or sensor, but other such sensors such as the magnetic sensor, contact sensor or the like may optionally be used. Note that sensor 54 is positioned to sense registration indicia on the inside surface of label 11. In the configuration of FIG. 8, the inside (i.e. printed) surface of label 11 is rolled inwardly on roll 11 and faces outwardly on the vacuum drum 61. After passing sensor 54, the labelling passes onto cutter 51 which includes a rotary cutting blade which engages stationary cutting blade 53 to cut singular labels from the continuous roll of the label base. After the cutter, the label is transferred onto working surface 62 of vacuum drum 61. Working surface 62 is preferably elastomeric and porous, having a vacuum to draw labels thereon as is known in the industry. Note, however, that working surface 62 is preferably perfectly cylindrical or in other words a true cylinder without raised ribs or other surfaces.

Figure 9:
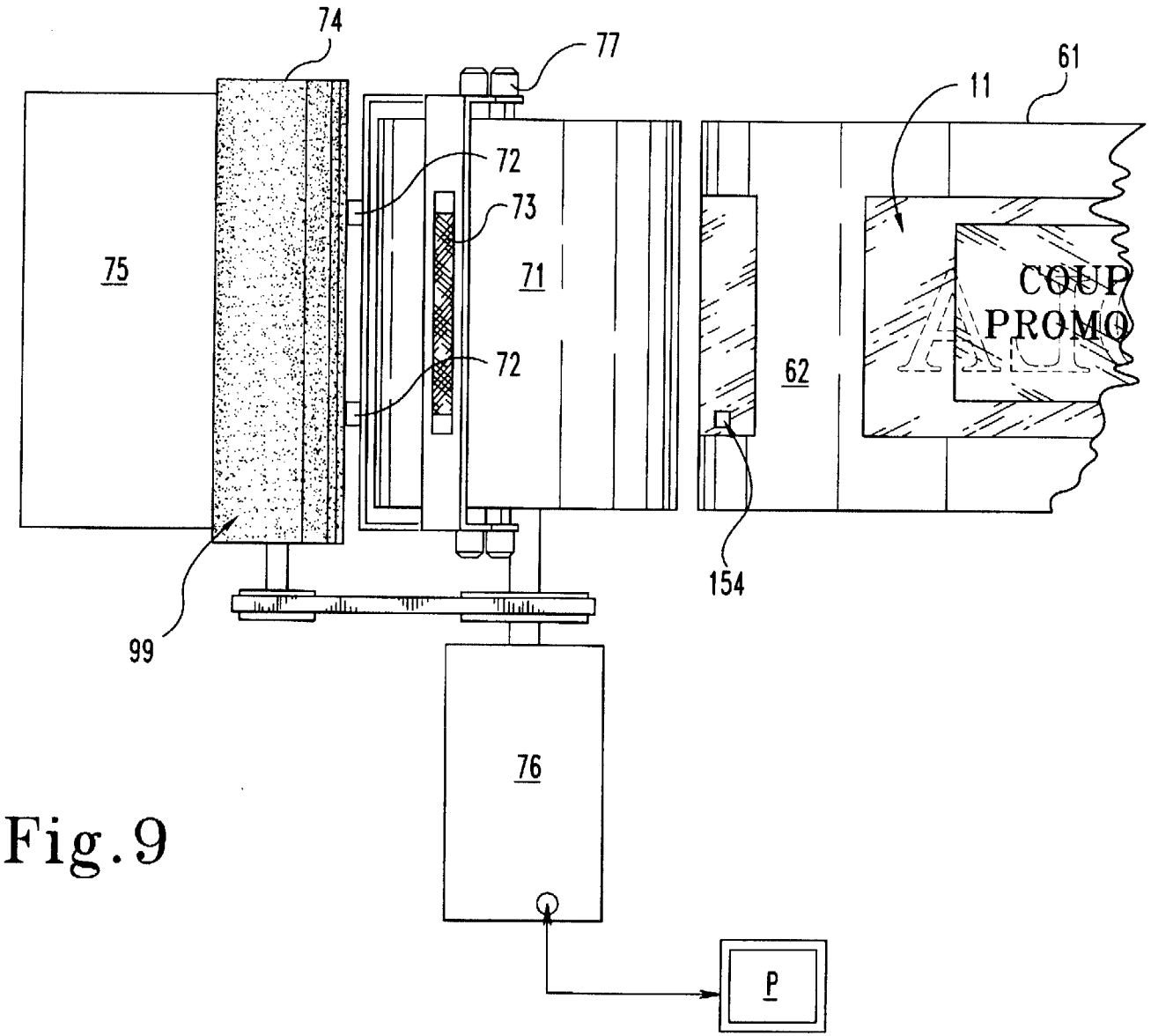
FIG. 9 is a side elevation detail of an adhesive applicator according to the present invention.

The labels on working surface 62 are rotated past glue applicator rotating member 71. Applicator member 71 preferably has at least one, and more preferably two, adhesive applicator members projecting radially away from the axis rotation of member 71. Specifically, applicator 72 and applicator 73 are provided for applying adhesive to the labels on their leading edge and trailing edge, respectively, in the illustrated configuration. Member 71 is rotated in synchronization with the labels rotating around on working surface 62 of the vacuum drum. Adhesive applicators 72 and 73 brush into contact with adhesive supply roller 74 which rotates with a continuous supply of adhesive thereon supplied from adhesive source and doctor bar unit 75. Applicators 72 and 73 continue rotating and are spaced to precisely contact the leading and trailing edges of the labels. FIG. 9 further illustrates this arrangement. Applicator 72 preferably is not an entire strip, but rather an upper and a lower contact point corresponding to the application of adhesive 99*a* (see FIG. 5); and, likewise applicator 73 is preferably a vertical elongated strip corresponding to adhesive strip 99*b*. Preferably, the contact surfaces of members 72 and 73 are knurled or otherwise textured to help hold liquid adhesive. It is to be understood that within the meaning of the present invention, the term "adhesive" includes a variety of glues, adhesives or other bonding substances, including hot melted adhesives, evaporative adhesives, and solvents known generally in the labelling industry. A preferred adhesive used in accordance with the present invention is 70-3892 Instant-Lok (trademark) offered by National Starch & Chemical Company of Bridgewater, N.J., U.S.A., namely a hot melt adhesive. It has been found that such adhesive is satisfactory being utilizable at temperatures less than 230° C. This typically is important given the preferably extremely thin nature of film layer 21 and its susceptibility to deformation at excessive temperatures. FIG. 9 illustrates roller or member 71 being shaft driven by motor 76. Also as illustrated a pulley or other system operates to rotate glue supply roller 74 providing adhesive 99 on its outer surface. Motor 76 preferably is a servo motor, although optionally may comprise a stepper motor, electronically coupled to a common computer or microprocessor P, to other functions of the system. This allows synchronization of engagement of members 72 and 73 with the label, typically based on registration control using registration indicia 154. It is to be understood that motor 76 and processor P typically include a motor controller interface known in controlling such motors.

Glue applicator members 72 and 73 are preferably movable and/or interchangeable, such as by loosening and removal of bolts or other mechanical attachments mechanisms, such as bolt 77. In this way, the spacing, geometry and/or configuration of the glue applicator members may be adjusted or interchanged to accommodate labels of various lengths, widths or various adhesive application requirements. Optionally, although not preferred, the entire rotating member 71 may be replaced and/or interchanged.

The arrangement of these glue applicators with true cylindrical working surface 62 are important in their interaction with the wrapping of labels in connection with radially distance D (see FIG. 8) between working surface 62 and curved wall 92. By virtue of working surface 62 being truly cylindrical and the inside wall surface of wall 92 having a circular profile about the axis of rotation of vacuum drum 61, the radially distance D is maintained perfectly constant throughout the wrapping operation of container C induced by the rotation of drum 61, and the movement of star wheel 81 and conveyor 91. Given the absence of raised surfaces enabled by the arrangement of adhesive applicator 71 with members 72 and 73, there are no intermittent fluctuations in distance D, thereby avoiding skips and interruptions to the rotation of container C in the wrapping of the label therearound. Accordingly, undesirable slack and looseness of the label wrap is substantially avoided or eliminated, providing an enhanced and tightly wrapped finished product.

Figure 10:
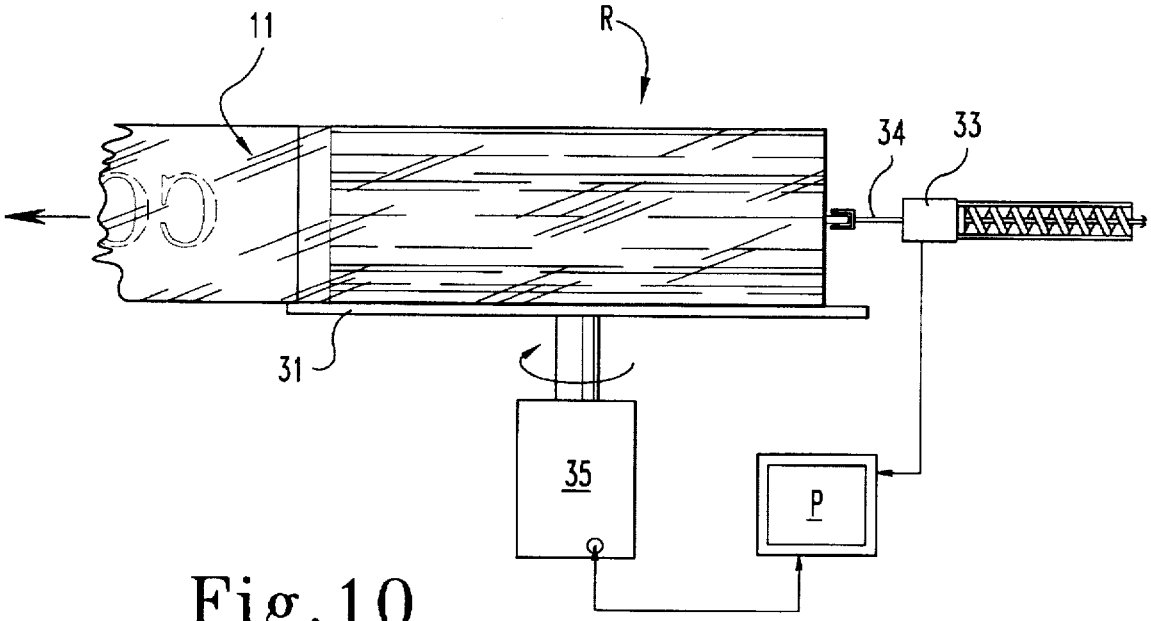
FIG. 10 is a side elevation detail of one embodiment of a supply roll according to the present invention.

FIG. 10 illustrates an optional and novel feature of the present invention, namely affirmatively unwinding the roll of labels R by a motor drive 35. Conventional labelling machinery of this type unrolls roll R merely by tension exerted on the label base, typically due to pull by feed roller 41. In certain applications this is acceptable. However, with particularly elastic, fragile, and/or thin film materials such force may cause undue stretching and deformation of the label web. This is problematic in maintaining proper registry since the label length can become a fluctuating variable and the label web is susceptible to breakage. Motor drive 35 induces torque on supply roll table 31 to affirmatively unwind the roll of labels. Drive 35 is preferably is a controlled speed motor, controlled by a controller such as microprocessor P or other such controller. By motor 35 rotating roll R, it is preferred that the speed of rotation at the tangent point of unwinding 32 (see FIG. 8) approach or equal (but preferably not exceed) the label feed rate through the remainder of the system. In this way, longitudinal stress and strain are reduced or completely eliminated between the supply roller and a feed point, such as feed roll 41. By placing the sensing means, such as sensor 54 at a location to read the registration indicia on the web in such nonstressed condition, more accurate readings may be had with less variations. Motor 35 preferably, as stated, is variable speed to account for fluctuations in the feed rate as well as to account for increased speed requirements as the diameter of roll R decreases due to unwinding of labels. In this regard, various mechanisms may be used to monitor feed rate and increase the speed of motor 35 using controller P. One such example is through radius sensor 33 (see FIGS. 8 and 10). Sensor 33 may include radially reciprocating arm 34 having a roller wheel and being spring biased inwardly. Sensor 33 provides radius data to processor P to translate rotational speed of motor drive 35 and the radius of the roll into a linear feed rate of label 11. Alternatively, sensor 33 may comprise an optical sensor reading registration indicia, allowing computer controlled variations of motor speed of motor drive 35 using the same or similar registration/synchronization control system described below with respect to cutter registration. Alternatively, a sensor may count total registration indicia which have passed, with processor P being a preprogrammed to project (within acceptable variance) the correlation between the number of registration indicia which have passed and the diminishing diameter or roll R. A corresponding signal to increase motor speed proportionally is sent from processor P to motor drive 35. Although motor 35 may optionally comprise a stepper motor, servo motor or otherwise, in the interest of cost savings it is believed that a lower cost variable speed motor, such as a rheostatically controlled more conventional motor is suitable for this particular application.

Figure 11:
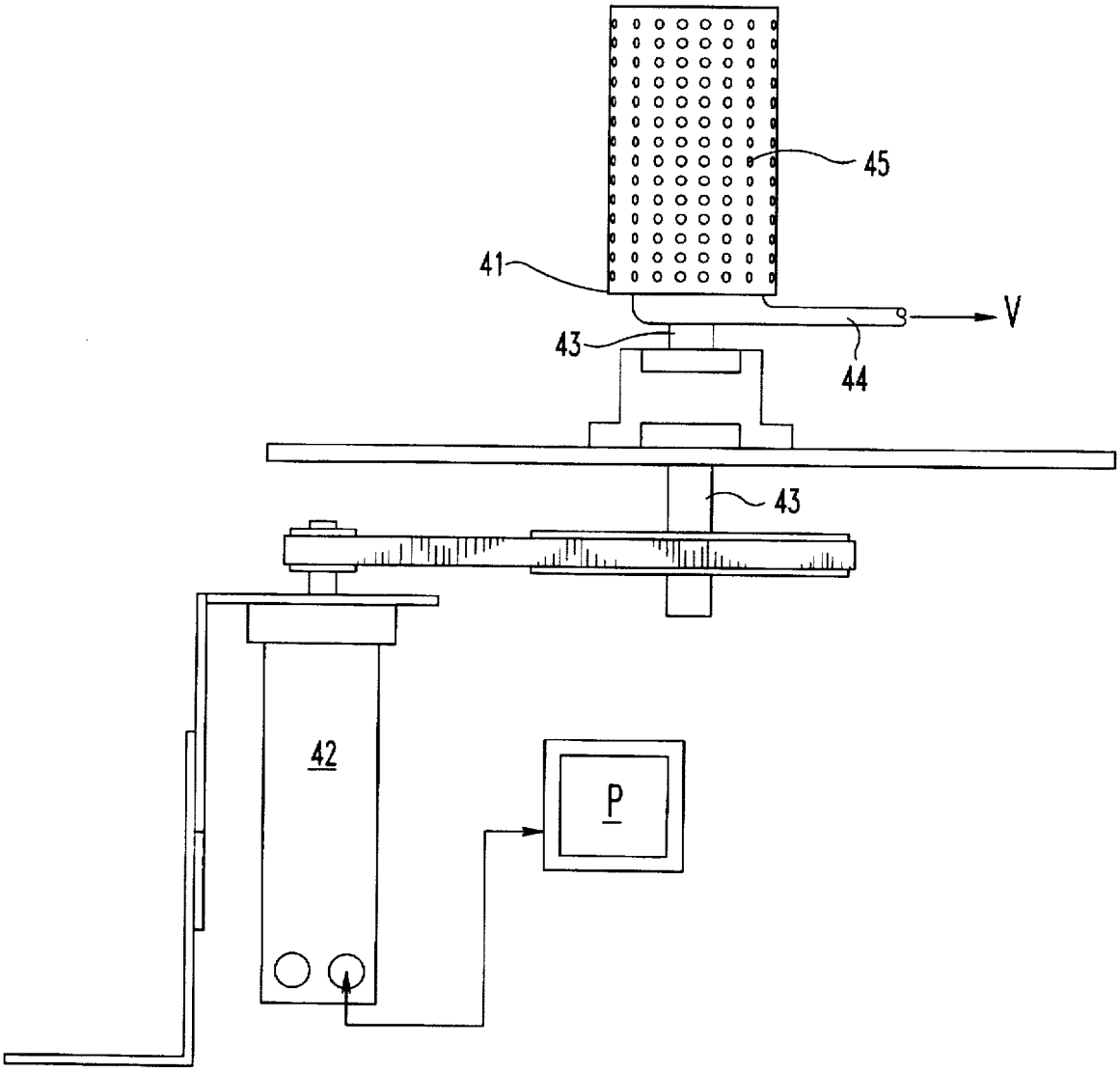
FIG. 11 is a side elevation detail of an alternative embodiment of a feed roller having a vacuum thereon according to the present invention.

FIG. 11 illustrates another optional feature of the present invention. Specifically, feed roller 41 is provided having a plurality of openings, such as opening 45, along its working surface thereof to pull a vacuum along the working surface of feed roller 41. Vacuum is pulled using vacuum manifold 44 and vacuum source V. Feed roller 41 is driven by shaft 43 shown with a pulley and belt coupling to motor 42. Motor 42 preferably is a servo motor, such as offered by Pacific Scientific Company Motor & Control Division of Rockford., Ill., U.S.A., Model No. R34KENC-R2-NS-NV-00. Motor 42 is coupled to processor P such as using a motor control (Model. No. SC753A-001-01) from the Pacific Scientific Company. Note that the motor control system with processor P and motor 42 described further below may be used without the optional feature of vacuum orifices 45 and vacuum manifold 44 as more conventionally known. However, the utilization of a vacuum surface on a feed roller between the cutter and the supply roller, insofar as applicant is aware, is novel and nonobvious. Preferably, such feature is used without the presence of a pinch roller, thereby allowing a degree of slippage between the label web and the feed roller. Such feature may advantageously mitigate tensile shock induced on the web. Moreover, such feature allows the feed roller to be rotated at an over speed rate (optionally a fixed over speed rate) with label feed rate being controlled at the upstream end, such as by precise controlled rotation of the supply motor 35.

Figure 12:
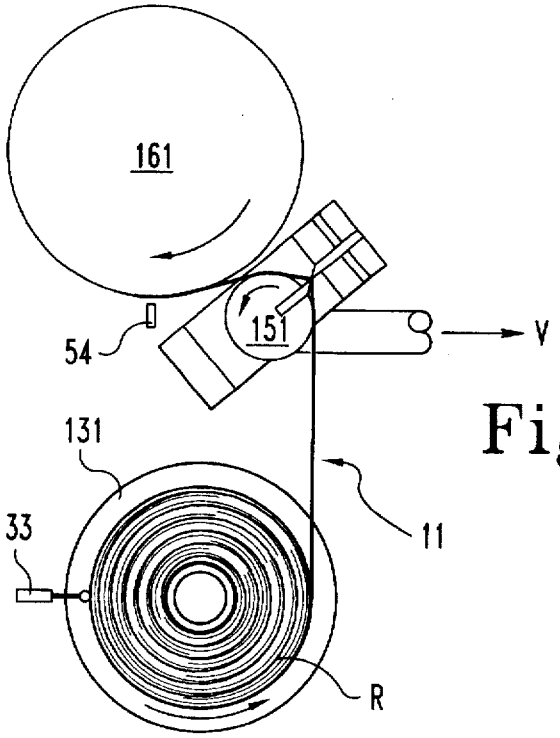
FIG. 12 is a top plan view of an alternative embodiment of the present invention.

A variation of this concept is disclosed in the alternative embodiment of FIG. 12. FIG. 12 illustrates an embodiment in which supply roll R is unreeled from supply roll table 131, feeding label 11 into rotary cutter 151. In the illustrated embodiment, intermittent tension rollers are omitted, and furthermore a feed roller is omitted, this function being taken by cutter roller 151. Cutter roller 151 is attached to a vacuum source V, and has openings therein similar to the feed roller 41 illustrated in FIG. 11. Accordingly, vacuum drawn on cutter roller 151 advances label 11 towards the cutting position when the rotating blade rotates past the stationary cutting blade. However, the vacuum drum arrangement allows relative slippage between label 11 and vacuum drum 151. Registration control is provided by microprocessor controlled servo motor rotational unwinding of table 131 and roll R, such as described in connection with the system of FIG. 10. Sensor 54, such as an optical scanner, provides registration indicia data to the microprocessor. As illustrated in FIG. 12, sensor 54 is positioned to read indicia on the inside surface of the label along the working surface of vacuum drum 161 prior to adhesive application (not shown) and prior to wrapping on to containers (not shown). In lieu of or in addition to such positioning, sensor 54 may be positioned between roll R and cutter 151. When indicia 154 is a window, a separate light source may be provided across from the scanner 54.

Figure 13B:
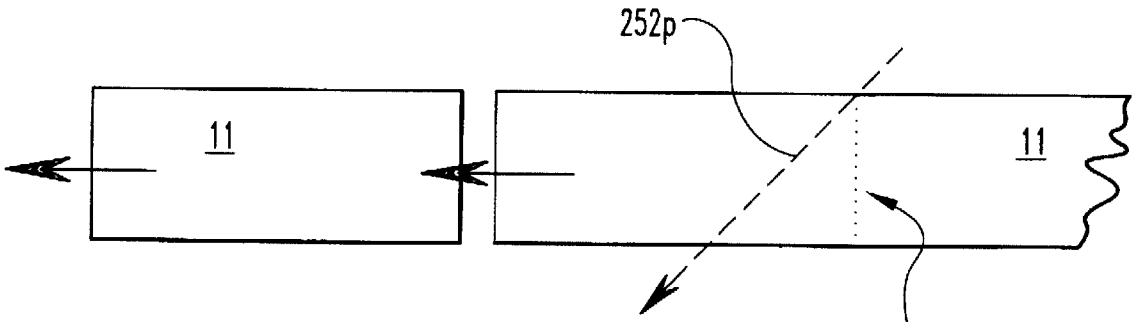
FIG. 13*b* is a diagrammatic illustration showing the movement path of the laser beam cutter and/or the adhesive jet spray applicator according to the device of FIG. 13*a*.
Figure 13A:
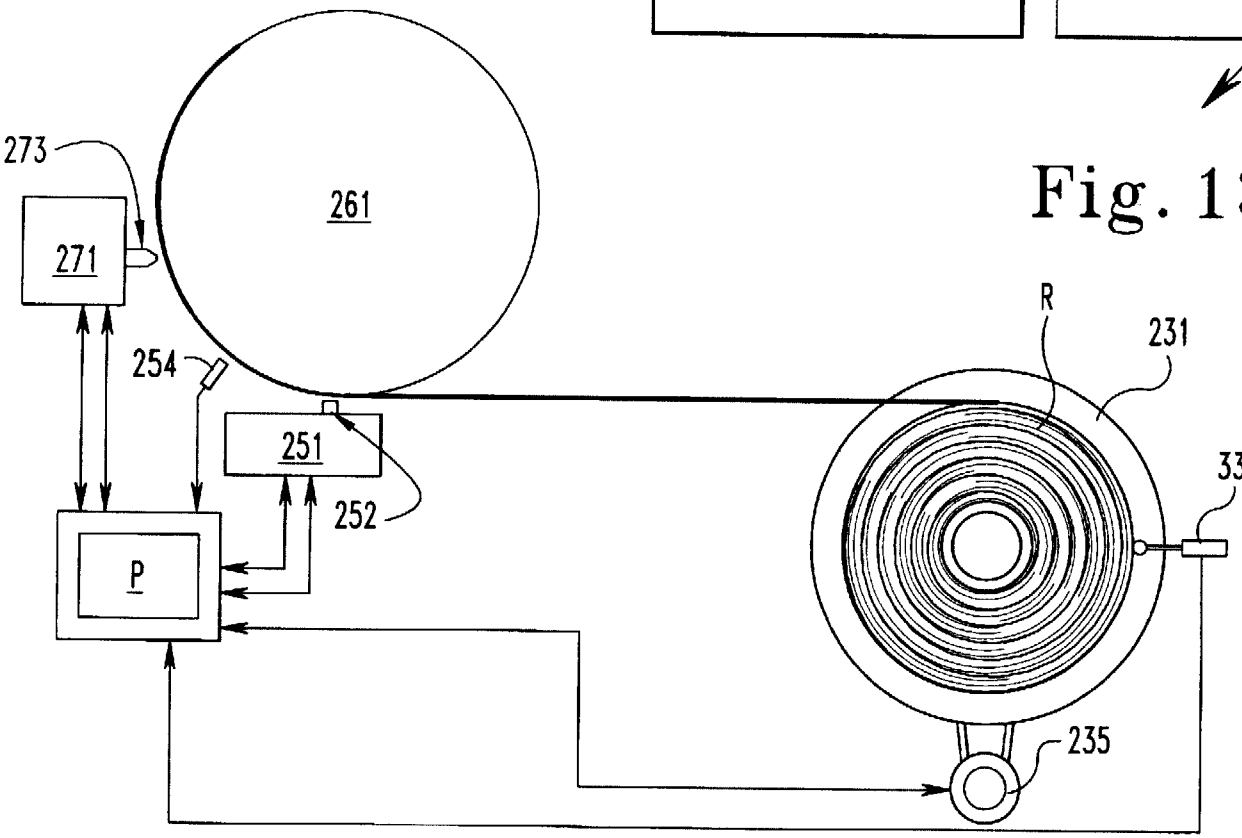
FIG. 13*a* is a top plan view of yet another alternate embodiment of the present invention utilizing a laser cutter and a jet spray adhesive applicator, each of which is computer controlled.

FIG. 13*a* illustrates yet another embodiment of the present invention. A supply roll of labels R is mounted on supply roll platform 231 and supplies rolls to vacuum drum 261. Microprocessor/computer P controls operation of the system. A laser beam cutter 252 is provided in a reciprocating action housing 251 which moves cutter selectively in a vertical direction (Y coordinate) and in a horizontal direction (X coordinate) to effect controlled cutting of the label, preferably directly on vacuum drum 261. FIG. 13*b* diagrammatically illustrates the path 252*p* of laser cutter 252 to effect a vertical cut 211. Such diagonal path 252*p* includes a horizontal velocity component equivalent to the linear feed rate of label roll 11 around drum 261. Note that drum 261 is surfaced with a suitable heat resistant surface to avoid damage caused by a light or other energy beam from beam emitter 252. Microprocessor P receives input data from a sensor, such as optical scanner, 254 to ascertain label feed rate. Processor P controls motor drive 235 which controllably unwinds roll R at a desired label feed rate, typically in synchronization with the supply of containers to be wrapped (not shown). Unit 251 activates the cutting beam, and supplies both vertical and horizontal component speed functions in the profile of path 252*p* to effect the desired cut, typically a vertical cut. Such vertical and horizontal components may be provided by various means, including servo motor or stepper motor controls geared to move a gear rack mounting holding beam emitter 252. For simplicities sake, the vertical velocity component of cutter 252 may remain constant with the horizontal component being variable and computer controlled in response to the label feed rate.

Such laser beam cutting may be included in combination with more conventional glue applicator systems. However, it is preferred that a similar computer controlled glue applicator jet spray nozzle 273 be used. Such nozzle functions effectively the same as a jet spray printing nozzle, such as used in computer controlled printing operations. Liquid adhesive is sprayed from nozzle 273 in a desired pattern, preferably along the leading and trailing edges of the label as previously described. Vertical and horizontal movement control of nozzle 273 is effected by controller 271 using similar principles as described in connection with unit 251, providing a diagonal spray path such as path 252*p* to effect a vertical array of adhesive. Preferably, the rotational feed rate of vacuum drum 261 and of the supply roller are accurately synchronized to minimize stretching or tension in the label web.

Figure 14B:
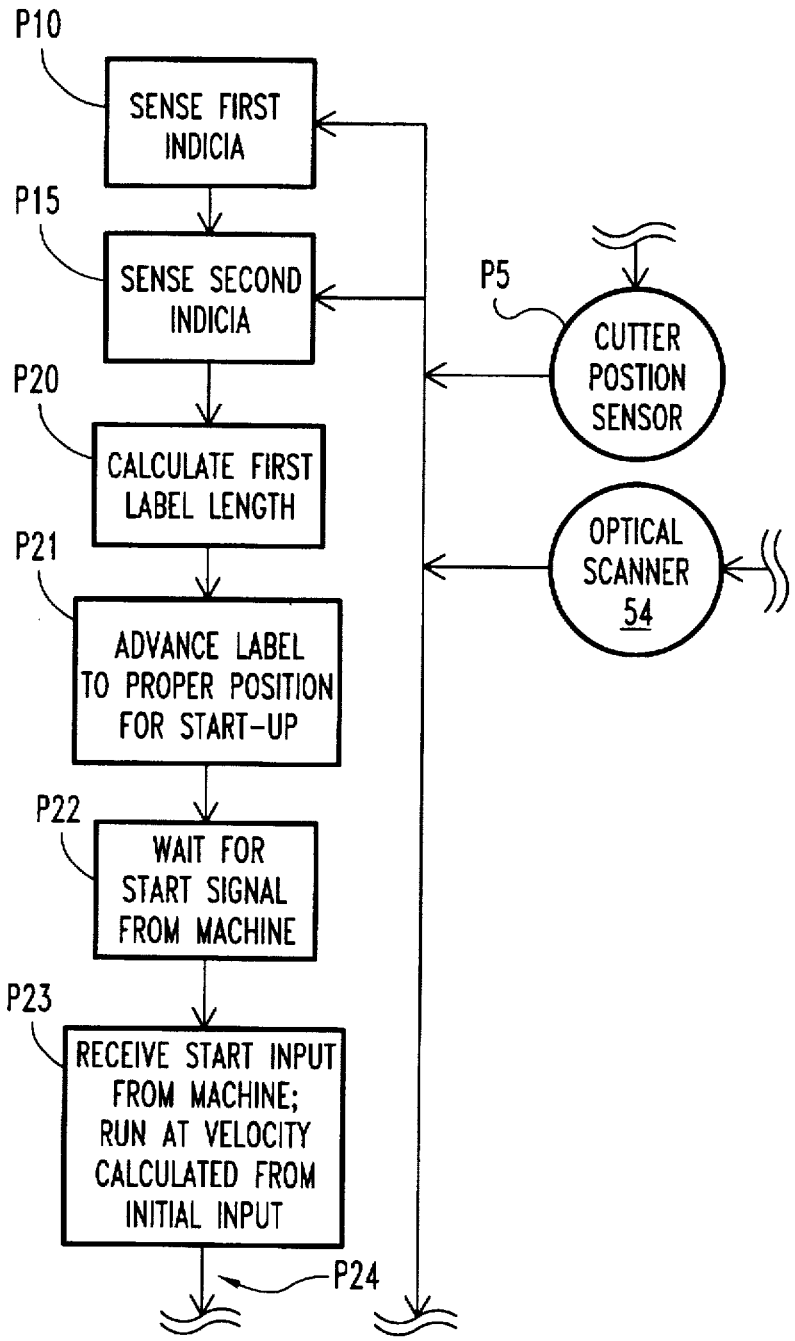
Figure 14C:
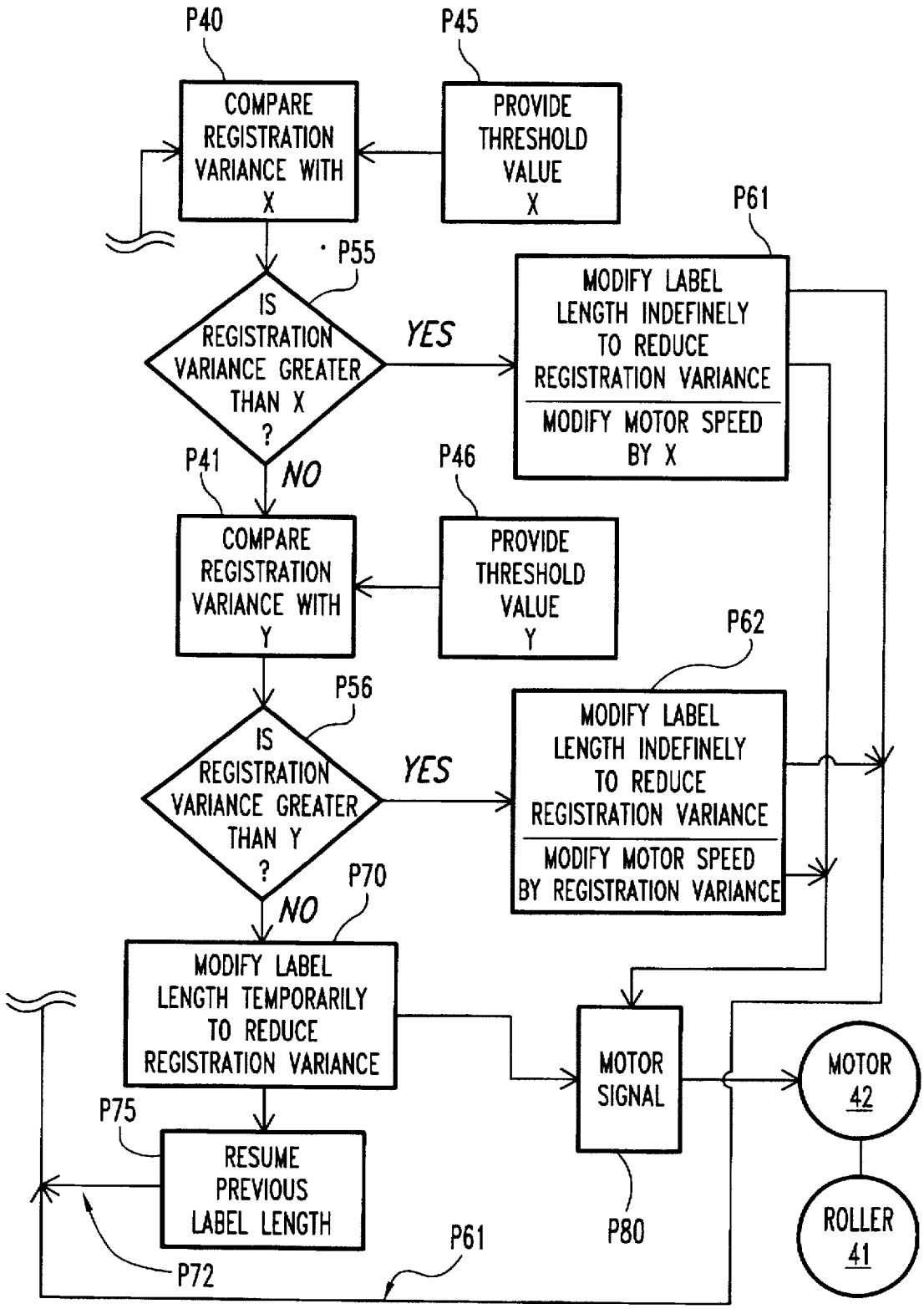

FIGS. 14*a*–14*c* illustrate logic flow charts according to preferred versions of computer controlling of registration in the present invention. It is to be understood that these flow chart of the registration/position control aspect of the present invention relates to registration controller of the cutter, and specifically of the operation of cutting the label 60 previously described. However, such registration/position control may also be used in connection with other operations, specifically including synchronization of the application of adhesive and/or synchronization of the engagement of the label with the container and wrapping therearound.

Two sources of data input are provided to controller P. The first is the cutter position sensor input P5 and the second is the registration indicia data from optical scanner 54. The cutter position sensor, also known as an encoder, has a monitoring mechanism to keep track of the cutter position, such as a tachometer, indicia reader or other mechanism known in the art, generating a signal when the cutter is in position to cut such as, for example, when the rotating blade passes the stationary blade in cutter 51 previously described. It is to be noted that in the preferred software program the operator inputs the measured (nonvariable) distance between sensor 54 and the cutter to allow the system to reconcile the operating distance therebetween. Note however that such distance, referred to as the eye-cut or "EC" distance, may be predefined in the software, particularly for an OEM unit in which the optical sensor and the cutter are integrated into a singular unit in which such distance does not vary. The present system is more simplistic and advantageous over prior systems which required a third input, namely input of the label length. The present system not only reduces the risk of operator error, but also facilitates the system being self-correcting for variable label lengths, and/or labels which are printed either out of tolerance or within tolerance but sufficiently variable as to adversely effect registration.

FIG. 14*a* and FIG. 14*b* illustrate a logic flow chart of the registration/position control system of the present invention. FIG. 14*b* illustrates a set-up sequence which is insertable in the illustrated block in FIG. 14*a* above arrow P24. Other set-up sequences may be followed. Function P10 (FIG. 14*b*) senses a first indicia on label 11. Thereafter, function P15 senses a second indicia which is subsequent to the first indicia. Function P20 calculates a first label length based on the data from functions P10 and P15. Typically such calculation is a simple subtraction calculation or counting of motor pulses. Note that in this function as well as other functions in the program "label length" may be translated into terms of motor pulses or resolver pulses of a servo motor or the like, taking into account feed roller diameter, and the number of resolver pulses or motor pulses per revolution for given brand of motor. For example, in one embodiment of the present invention drive motor 42 is made by Pacific Scientific Company of Rockford, Ill., U.S.A., Model No. R34KENC-R2-NS-NV-00 and has 4096 motor pulses per revolution. Using a feed roller 41 of a diameter of 3.65 inches, and a gearing/belt ratio between motor revolutions and feed roller revolutions of 4:1, a 14.00 inch label length translates to 20003.463 motor pulses. Of course, other variations may be utilized within the spirit of the present invention.

The set-up sequence illustrated in FIG. 14*b* includes sensing a first registration indicia in step P10. Such indicia is provided from scanner 54. Step P15 senses the second indicia, again preferably from the same scanner 54. Step P20 calculates the first label length, preferably in terms of motor pulses between steps P10 and P15. Step P20 involves advancing the label to the proper position for start up. Step P22 involves awaiting for the start signal from the machine, typically at the readout of the microprocessor. Step P23 involves receiving the start input from machine, typically operator activated with a start button, and thereafter running the web at a velocity calculated from the initial input from scanner P54 in steps P10, P15 and P20. Instructions for this start-up procedure are set forth further below in the portion entitled "EXAMPLE INSTRUCTIONS".

After calculation function of the set-up, or during operation of calculating the label length, the microprocessor determines or anticipates the location of the next indicia at function P25 based on the preceding label length. Thereafter, at function P30 the system senses the actual location of the next (or third) indicia. Function P35 compares the anticipated location of the next indicia with the actual location of the next indicia and calculates the registration variance by subtracting these values or other operation such as comparing ratios. It is to be understood that the registration variance may be a positive or a negative number, but that for purposes of the flow chart of FIG. 14 such values are considered in terms of magnitude, or in other words in terms of their absolute value in positive terms. In other words, a registration variance of-20 motor pulses would be considered to equivalent in magnitude to a registration variance of +20 motor pulses.

In function P40, the registration variance previously calculated is compared with a predefined threshold value "X". The threshold value X is preferably preprogrammed into the computer, and in the preferred system comprises 40 motor pulses. It is to be understood that within limitations such value may be modified according to design choice. Function P55 evaluates whether the registration variance is greater than X. If the registration variance is greater than X (in other words it is a large registration variance) the logic advances to function P60, described further below. However, if the registration is less than or equal to X (in other words the registration variance is relatively small) the controller logic proceeds to function P70. It is within the scope of the present invention to modify function P55 so the registration may be "greater than or equal to" X.

If the registration variance is greater than the threshold value X, function P60 involves two steps. The first is to provide a signal to motor signal controller indicated at arrow P82 and function P80. Such motor control signal varies the speed of motor and correspondingly the speed of feed roller drum 41, either increasing or decreasing the speed if the label registry is lagging behind or ahead of, respectively, its desired location. Moreover, function P60 as denoted by arrow P61 modifies the "label length" (typically expressed in terms of motor pulses) inputted for use in the function P25 of anticipating the location of the next indicia for the next label. In other words, if there is a registration variance of sufficiently large size, the system "learns" of such a deviation and modifies where it anticipates the location of the next indicia. Such feature is especially useful where there are significant variations in label length from one label to the next. An example of such phenomenon is where two rolls of label are spliced together where the two labels were printed independently of one another and have different true label lengths due to variations within printing tolerances. For example, a first roll may be printed nominally 14 inches plus or minus 1/32 of an inch so that it has an actual label length of 13 and 31/32 inches true label length; whereas, the second roll may be printed at a nominal length of 14 inches plus or minus 1/32 of an inch with a true label length of 14 and 1/32 of an inch. Accordingly, these labels will vary by 1/16 of an inch in actual label length. Such problems may be compounded by other factors such as imperfect splicing, temperature variations, mechanical stretching and otherwise. The present system self corrects by learning that although the original base label length was 13 and 31/32 of an inch, it must now modify or "learn" that the new base label length is 14 and 1/32 of an inch. Any fine tuning variations thereon are addressed in connection with function P70. Note further that the adjustments from function P60 modify the label length indefinitely and the system retain such modifications until such time as subsequent series of labels cause function P55 to recognize a registration variance in excess of the threshold value X. Although the preferred version of the present invention provides in function P45 a threshold value X which is a fixed value, it is possible to provide modifications to threshold value X based on monitoring of actual label length.

If in function P55 the registration variance is not greater than X, function P70 modifies the label length temporarily to reduce registration variance, such modification being on a temporary basis. Preferably, such "temporary" or interim basis is a single label. For example, in FIG. 14 arrow P81 provides a signal to motor signal function P80 to increase or decrease, respectively, motor speed 42. The motor signal may comprise a single signal of twenty motor pulses (i.e. less than 40 motor pulses) to adjust registration. In this way, the base label length/base feed rate remains the same while the system is able to fine tune registration for any given label. Function P75 resumes the previous label length after the temporary modification in label length denoted by arrow P81 has been effected. Arrow P72 likewise leads back to function P25, anticipating the location of the next indicia. However, since the registration variance in function P55 was not greater than X, during this cycle the anticipated location of the next indicia will based on the same anticipated label length as previously used. This will remain the same until such time as a label length is indefinitely modified pursuant to function P60 in the event that registration variance is greater than threshold value X.

Referring now to FIG. 14*c*, an alternative modification of the flow chart of FIG. 14*a* is illustrated. Specifically, the flow chart of FIG. 14*a* is modified beginning with function P40 in FIG. 14*a*. In general terms, the flow chart of FIG. 14*c* adds a second level of registration variance inquiry based on a second threshold value Y as depicted in functions P41, P46, P56 and P62. More specifically, the system of FIG. 14*c* and function P40 compares to registration variance with X, a threshold value provided at function P45. In function P55, the system determines whether the registration variance is greater than X. If the variance is greater than X, function P61 is performed, namely to modify the label length indefinitely to reduce registration variance, and furthermore the motor speed is modified by a value, preferably with that value equal to X. However, in function P55 if the registration variance is not greater than X, function P41 compares a registration variance with a second threshold value Y provided in function P46. A similar inquiry is asked in function P56, namely whether the registration variance is greater than Y. If the registration variance is greater than Y, function P62 likewise modifies the label length indefinitely to reduce registration variance, similar to with function P61. Likewise, function P62 modifies the motor speed, although preferably this differs frown P61 in that the motor speed is not modified by the value X, but rather by the value of the registration variance, providing motor signal function P80 with the impetus to modify the motor speed of motor 42 and the corresponding speed of roller 41. In function P56, the registration variance is not greater than Y, function P70 modifies the label length temporarily. Preferably, this temporary variance to motor signal function P80 equals the amount of the registration variance. By way of example only, the threshold value X in the illustrated embodiment actually comprises a range between minus 60 and plus 120 motor pulses. Likewise in the system set forth as an example, the threshold value Y of FIG. 14*c* ranges between minus 40 and plus 40 motor pulses. Thus, for example, if the registration variance were 130, function P61 would modify the motor speed by X, namely 120, and would likewise modify the label length. Such label length modification is preferably done ratiometrically, such as by multiplying the previous label length by a coefficient of 1.001. Step P62 may use a similar coefficient approach. By way of further example if the registration variance is 70 (between 40 and 120) function P62 would modify the label length and modify the motor speed by the registration variance, namely 70. If the registration variance were 30 (i.e. less than 40) function P20 would temporarily modify the motor speed by 30 motor pulses.

It is important to note that in the preferred embodiment, the present invention places limitations on the amount of variations and motor speeds which are signaled by arrows P81 or P82. Typically, such variations are controlled in incremental steps, rather than all at once. In this way, particularly when there are large registration variances, corrections are made over several labels, rather than a single label. This feature is particularly important when using highly elastic or fragile films, such as single-ply film layer 21 previously discussed so that the acceleration or deceleration rate of the motors and drive systems is limited. Otherwise, there is an increased risk of breaking or undue deformation of the web material. However, we have found the thin film according to the present invention has advantages over conventional two-ply film, namely it has less memory and associated curl. This allows for fast operations, such as between the cutter and the vacuum drum, particularly in combination with the present inventive registration control system. Tests have shown very satisfactory results at rates of about 220 fourteen inch labels per minute average with peak rates of about 300 fourteen inch labels per minute. It is believed even higher rates are possible with the present invention, particularly with the registration indicia detectable along the back side of the single-ply film.

Other optional functions not illustrated in the flow chart of FIG. 14*a* may be included. For example, where registration indicia are used on a nonblank field, such as on the outside face of the label, the operator may be required to input a "window" in which the registration indicia is expected. Between windows, the system disregards input signals as merely extraneous matter. However, as discusses above where the registration indicia is placed on the inside surface with a blank field between registration indicia, this window function is not required and the operational speeds and response time of the system may be greatly enhanced since the optical scanner "window" is always open. Further functions may include recognition of a complete loss of registry and a shutting down of the system if registration marks are not obtained within a predefined number of motor pulses.

Moreover, it is to be understood that the foregoing registration control system may be readily adapted to other web materials beyond continuous film labels as described herein. Such materials may include two-ply or surface printed webs, sleeve and pouch webs, paper webs, printing operations, and other such mechanisms where registration control is required, substituting the word "web" for "label". Moreover, even in the context of labelling operations or the other operations set forth above, registration control may be utilized in connection with operations other than cutting operations, as disclosed. For example, in FIGS. 14*a* and 14*b* the cut label 60 and cutter position sensor function P5 may be substituted with glue applicator function and glue applicator position functions or other functions. Examples include the star wheel, the vacuum drum, the supply roller, flow control mechanisms for the containers, conveyors, or any other moving part needing synchronization. Similarly, in FIGS. 14*a* and 14*c*, motor 42 may be substituted with motor 35 or other such drive mechanisms in the system or as listed above.

A preferred embodiment of one exemplary computer program usable in the present invention is set forth in FIGS. 15*a* through 15*g* in SC750 SERVO BASIC PLUS (trademark) (Version 1.2) computer language from Pacific Scientific. Input to the processor/controller may be provided using a Model TM2500 microterminal from Burr-Brown Corporation of Tucson, Ariz., U.S.A. Steps followed by the operator in providing initial set-up input and operation are as follows:

EXAMPLE INSTRUCTIONS

Thread label through the guide rollers and through the feed roller.

Setup

To be done each time the system is powered down or for label size changes.

1. Set up Scanner to read register mark.

A. Place register mark under the scanner beam.

B. Set for light or dark mark. If the mark is dark set scanner to light operation. If the mark is light set scanner to dark operation.

c. Adjust sensitivity to read mark.

2. Place the register mark one-half inch before the scanner beam.

3. Turn on system power.

4. Press system reset button to start system.

5. Wait for prompt "Feed Roller Diameter" on display.

6. Enter feed roller diameter (very accurately).

The accuracy of this entry will effect the label length display and the accuracy of the eye-cut distance but will not effect registration control.

7. Press the enter button on panel.

8. Wait for prompt "Eye-Cut Distance" on display.

9. Enter distance from scanner to cutter knife plus one-half inch and press enter (Example: 21.25 inch). (This entry sets up the cut position and may have to be altered according to the parameters of the machine. )

10. Press the enter button.

The feed roller will move the registration mark to the scanner, pause and then start moving the label toward the next registration mark. When the scanner beam reaches the "window" or clear area (no graphics) prior to the ext registration mark press the "Yes" button on the control panel. This tells the system where to look for the mark and to ignore any other marks. The feed roller will pause, then move the register mark to the scanner beam.

11. Display will prompt "Is This the Mark". If the scanner is seeing the correct register mark press the "Yes" button.

12. The system will then automatically position the label to the proper cut position.

13. Tear off excess label and thread label into the cutter.

14. Press the machine run button.

15. Press the manual label feed and run several labels.

16. Check for proper cut-off.

If the cut position is not correct the measurement entered in step was not correct. Check the distance the cut is off (registration variance), press the reset button and start over. Alter the entry of Step 9 according to the amount the cut is off.

17. Minor adjustments to the cut-off position may be made by pressing the advance or retard buttons. The cut will be changed by approximately 1/32 inch each time the advance or retard button is pressed and released. When unning do not press the advance or retard button more than two times per label (especially the retard button—the label could be shortened enough so it will not cover the vacuum drum pads and glue could be applied to the vacuum drum pads).

18. Set-up is complete.

Operation

1. When the machine is running labels the operator panel will display the following information.

A. Register errors:

1. Correction—# retard correction

2. Correction # advance correction

B. Length adjustments:

1. Rat.Chg.—# shortens label

2. Rat.Chg. # lengthens label

This function will adjust the system for variations in the actual label repeat length. The cut-off position could be affected by these corrections if the label length variations are excessive. Cut position can be altered by the advance or retard buttons.

Label Size Changes (Example two liter to three liter) Press the reset button and go through the set-up procedure with the new label size.

While the invention has been illustrated and described in detail in the drawings and foregoing description, the same is to be considered as illustrative and not restrictive in character, it being understood that only the preferred embodiment has been shown and described and that all changes and modifications that come within the spirit of the invention are desired to be protected.

What is claimed is:

1. A process for labelling a series of containers with a labels providing images to be displayed, comprising the steps of:

providing an elongated continuous flexible label base consisting essentially of a single-ply transparent film having a thickness of less than about two mils and having an inside surface and an opposite outside surface;

first printing a plurality of sequenced printed images on and along said elongated continuous flexible label base on the inside surface of said film, wherein the printed images are reverse printed on the inside surface in a mirror image of the images to be displayed on the containers;

printing a substantially opaque coating on and over the inside surface of said film at least on portions of said film not printed with said printed image wherein essentially all of the inside surface of the transparent film is coated with a print coating to provide substantial opacity across essentially all of the label;

sequentially cutting singular labels having a printed image thereon from said elongated continuous flexible label base;

wrapping and adhering the cut labels around an outside surface of the container with the reverse printed image being located between the transparent film and the container, wherein said printed image is viewable through the single-ply film as the displayed image and the opaque coating obstructs viewing of the container through the film.

2. The process of claim 1 wherein said transparent film has thermal expansion and contraction characteristics that said film will contract more than about 10% linearly when heated to a temperature ranging between 150° F. and 210° F.

3. The process of claim 2 wherein said printed label base is a continuous roll of labels, said cutting step including cutting said labels apart from said roll to define a leading edge and a trailing edge of said labels, and wherein said wrapping and adhering step comprise the steps of applying a first adhesive to an inside surface of said labels along their leading edge, adhering said leading edge to the container with said first adhesive, applying a second adhesive to an inside surface of said printed label base along said trailing edge, wrapping the label base circumferentially around the container, and adhering said trailing edge with said second adhesive.

4. The process of claim 3 and further comprising the step of coating a leading edge portion and a trailing edge portion of said printed label with a release agent, wherein said release agent weakens adhesive bonding strength of said adhesive to allow convenient removal of the label from the container.

5. The process of claim 4 wherein said transparent single-ply film is selected from the group consisting of: polyethylene and polypropylene.

6. The process of claim 5 and further comprising the step of printing a second opaque coating over said previous opaque coating to further enhance opacity of the label.

7. The process of claim 6 wherein the first opaque coating is white, and wherein said reverse printed image is nonwhite, and wherein said first opaque coating is printed over the entire inside surface of the film including being printed over said reverse printed image.

8. The process of claim 7 a further comprising the step of printing a second printed image in nonreverse print over said opaque coating, wherein said second printed image is located between said opaque coating and the container and is obstructed from view by the opaque coating when the label is on the container, and wherein the second printed image is viewable upon removal of the label from the container.

9. The process of claim 8 wherein said container comprises a bottle comprising polyethylene teraphthalate having a cylindrical side wall portion, and further comprising the step of filling the bottle with a human-consumable liquid beverage.

10. The process of claim 1 wherein said printed label base is part of a continuous roll of labels, said cutting step including cutting said labels apart from said roll to define a leading edge and a trailing edge of said labels, and wherein said wrapping and adhering step comprise the steps of applying a first adhesive to an inside surface of said labels along their leading edge, adhering said leading edge to the container with said first adhesive, applying a second adhesive to an inside surface of said printed label base along said trailing edge, wrapping the label base circumferentially around the container, and adhering said trailing edge with said second adhesive.

11. The process of claim 1 and further comprising the step of coating a leading edge portion and a trailing edge portion of said printed label with a release agent, wherein said release agent weakens adhesive bonding strength of said adhesive to allow convenient removal of the label from the container.

12. The process of claim 1 wherein said transparent single-ply film is selected from the group consisting of: polyethylene and polypropylene.

13. The process of claim 1 and further comprising the step of printing a second opaque coating over said previous opaque coating to further enhance opacity of the label.

14. The process of claim 1 wherein the first opaque coating is white, and wherein said reverse printed image is nonwhite, and wherein said first opaque coating is printed over the entire inside surface of the film including being printed over said reverse printed image.

15. The process of claim 1 a further comprising the step of printing a second printed image in nonreverse print over said opaque coating, wherein said second printed image is located between said opaque coating and the container and is obstructed from view by the opaque coating when the label is on the container, and wherein the second printed image is viewable upon removal of the label from the container.

16. The process of claim 1 wherein said container comprises a bottle comprising polyethylene teraphthalate having a cylindrical side wall portion, and further comprising the step of filling the bottle with a human-consumable liquid beverage.

17. A process for providing cut labels for labelling a series of containers with labels providing images to be displayed, comprising the steps of:

providing an elongated flexible label base carrying a series of images printed thereon and wound into a supply roll, said images including registration indicia along the elongated label base, said registration indicia being located along said elongated label base corresponding to locations to be cut across said elongated label base;

passing said label base through means for sensing said registration indicia and through a cutter;

sensing input data from two sources, namely:

(2) sensing a first registration indicia with said means for sensing said registration indicia to provide first location data to a digital means for processing data; and thereafter sensing a subsequent second registration indicia with said means for sensing said registration indicia to provide second location data to said digital means for processing data; and, (2) sensing a cutter position of said cutter to provide cutter position data to said digital means for processing data;

calculating a first label length with said digital means for processing data based on said sensed first location data and said sensed second location data;

driving a controlled speed motor in response to signalling from said digital means for processing to advance said elongated label base through said cutter at a first base feed rate corresponding to said first label length and to said cutter position;

determining an anticipated location of a third registration indicia with said digital means for processing data based on said location data and said first label length;

sensing a third registration indicia with said means for sensing said registration indicia to provide actual third location data to said digital means for processing data;

comparing said anticipated location of the third registration indicia with said actual third location data with said digital means for processing data to determine a first registration variance;

modifying said calculated first label length with said digital means for processing data based on said first registration variance to establish a calculated second label length;

modifying said first base feed rate to a second base feed rate by signalling said controlled speed motor with said means for processing data to synchronize the label feed rate and said cutter; and, sequentially cutting singular labels with said cutter at said predetermined locations to be cut on said elongated flexible label base.

18. The process of claim 17 and further comprising the steps off comparing said first registration variance and an established threshold value with said means for processing data; and, when said first registration variance exceeds said threshold value, signalling said controlled speed motor with said means for processing data to modify said first base feed rate to said second base feed rate indefinitely until said second base feed rate is itself modified based on a subsequent registration variance which exceeds said threshold value; and, when said threshold value exceeds said registration variance, temporarily modifying said base feed rate for an interim time period and thereafter resuming the previous base feed rate.

19. The process of claim 18 wherein said elongated flexible label base comprises a continuous elastic polymeric film and has a base thickness less than about five mils, and wherein said step of modifying said first base feed rate utilizes variations of said label feed rate which are less than one percent of said feed rate per label to reduce stress said flexible label base.

20. The process of claim 17 wherein said elongated flexible label base consists essentially of a single-ply transparent film having an inside surface and an opposite outside surface and further having said plurality of sequenced printed images along said elongated flexible label base on the inside surface of said film, wherein the printed images are reverse printed on the inside surface in a mirror image of the images to be displayed on the containers, wherein said film further has a substantially opaque coating over the inside surface of said film at least on portions of said film not printed with said printed image wherein essentially all of the inside surface of the transparent film is coated with a print coating to provide substantial opacity across essentially all of the label.

21. The process of claim 19 wherein said registration indicia is machine readable along said inside surface of said elongated label base opposite the images to be displayed by said labels.

22. The process of claim 20 wherein said registration indicia comprise a series of printed marks on said inside surface.

23. The process of claim 20 wherein said registration indicia comprise a series of light transmissive windows which allow light transmission through said film.

24. A process for labelling a series of containers with a labels providing images to be displayed, comprising the steps of:

providing an elongated flexible label base consisting essentially of a single-ply transparent film having a thickness of less than about two mils and having an inside surface and an opposite outside surface;

first printing a plurality of sequenced printed images along said elongated flexible label base on the inside surface of said film, wherein the printed images are reverse printed on the inside surface in a mirror image of the images to be displayed on the containers;

printing a substantially opaque coating over the inside surface of said film at least on portions of said film not printed with said printed image wherein essentially all of the inside surface of the transparent film is coated with a print coating to provide substantial opacity across essentially all of the label;

sequentially cutting singular labels having a printed image thereon from said elongated flexible label base;

wrapping and adhering the cut labels around an outside surface of the container with the reverse printed image being located between the transparent film and the container, wherein said printed image is viewable through the single-ply film as the displayed image and the opaque coating obstructs viewing of the container through the film, wherein said sequentially cut labels have registration indicia along their inside surface, and further comprising the step of machine reading said registration indicia, wherein said registration indicia comprise a series of printed marks on said inside surface.

25. A process for labelling a series of containers with a labels providing images to be displayed, comprising the steps of:

providing an elongated flexible label base consisting essentially of a single-ply transparent film having a thickness of less than about two mils and having an inside surface and an opposite outside surface;

first printing a plurality of sequenced printed images along said elongated flexible base on the inside surface of said film, wherein the printed images are reverse printed on the inside surface in a mirror image of the images to be displayed on the containers;

printing a substantially opaque coating over the inside surface of said film at least on portions of said film not printed with said printed image wherein essentially all of the inside surface of the transparent film is coated with a print coating to provide substantial opacity across essentially all of the label;

sequentially cutting singular labels having a printed image thereon from said elongated flexible label base;

wrapping and adhering the cut labels around an outside surface of the container with the reverse printed image being located between the transparent film and the container, wherein said printed image is viewable through the single-ply film as the displayed image and the opaque coating obstructs viewing of the container through the film, wherein said sequentially cut labels have registration indicia along their inside surface, and further comprising the step of machine reading said registration indicia, wherein said registration indicia comprise a series of light transmissive windows which allow light transmission through said single-ply film.

* * * * *

UNITED STATES PATENT AND TRADEMARK OFFICE

CERTIFICATE OF CORRECTION

PATENT NO. : 5,741,381

DATED : April 21, 1998

INVENTOR(S) : Dale E. Dolence et al.

It is certified that error appears in the above-identified patent and that said Letters Patent is hereby corrected as shown below:

In column 1, line 46, please change "rail" to --mil--.
In column 1, line 51, please insert --run-- after "are", second occurrence
In column 1, line 64, please change "my" to --may--.
In column 2, line 8, please change "convections" to --corrections--.
In column 3, line 53, please delete "to", second occurrence
In column 5, line 58, please change "and" to --and/or--.
In column 7, line 16, please change "note" to --more--.
In column 7, line 18, please change "mill" to --mil--.
In column 7, line 51, please change "an." to --an--.
In column 10, line 31, please change "or" to --of--.
In column 10, line 47, please delete the period after "Rockford".

In column 14, line 66, please change "frown" to --from--.
In column 18, line 41, please delete "a".
In column 19, line 15, please delete "a".
In column 19, line 41, please change "(2)" to --(1)--.
In column 20, line 15, please change "off" to -of:--.

Signed and Sealed this

Twenty-third Day of May, 2000

*Attest:*

Q. TODD DICKINSON

*Attesting Officer*

*Director of Patents and Trademarks*